US006324790B1

(12) United States Patent
Victor et al.

(10) Patent No.: US 6,324,790 B1
(45) Date of Patent: Dec. 4, 2001

(54) DEPLOYABLE SEATING ARRANGEMENT

(75) Inventors: Daniel R. Victor, Kalamazoo; Melvin J. Guiles, Plainwell; Kenneth A. Ahrens, Schoolcraft, all of MI (US)

(73) Assignee: Interkal, Inc., Kalamazoo, MI (US)

( * ) Notice: Subject to any disclaimer, the term of this patent is extended or adjusted under 35 U.S.C. 154(b) by 0 days.

(21) Appl. No.: 09/388,839

(22) Filed: Sep. 1, 1999

(51) Int. Cl.[7] ..... E04H 3/12

(52) U.S. Cl. ..... 52/9; 297/236
(58) Field of Search ..... 297/236, 232; 52/8, 9, 10

(56) References Cited

U.S. PATENT DOCUMENTS 5,069,007 * 12/1991 Paddock ..... 52/9

FOREIGN PATENT DOCUMENTS

729958 * 3/1966 (CA) ..... 52/9
2416256 * 10/1975 (DE) ..... 52/9
2745803 * 4/1979 (DE) ..... 52/10

* cited by examiner

*Primary Examiner*—Peter M. Cuomo
*Assistant Examiner*—Jerry A. Anderson
(74) *Attorney, Agent, or Firm*—Raphael A. Monsanto; Benito J. Rohm; Richard A. Gaffin

(57) ABSTRACT

A deployable seating arrangement employs a plurality of seating level members that are arranged in sequentially elevated relation to one another. When the deployable seating arrangement is in an undeployed state, the seating level members are disposed substantially directly beneath one another in stacked relation. When in a deployed condition, each seating level member is disposed beneath and forward of an immediately superior seating level member in stepped relation. Each of the seating level members has associated therewith a plurality of L-shaped frame elements that are formed of vertical and horizontal portions. A roller is installed at the upper end of the vertical portion for engaging with the underside of the horizontal portion of an immediately superior seating level member. A drive arrangement having a wide track motor drive urges the seating level members, which are installed on a plurality of respective wheeled frame arrangements, into deployed and undeployed states. Each wheeled frame arrangement is arranged laterally inward of a wheeled frame arrangement associated with an immediately superior seating level member. Structural rigidity is enhanced by the use of triangulation frame members that couple the seating level members to their respectively associated wheeled frame arrangements. Each seating level member is additionally provided with a nesting guardrail at each end thereof, the guardrails forming a sequential protective barrier when the deployable seating arrangement is in a deployed state, and nesting with one another when in the undeployed state.

45 Claims, 28 Drawing Sheets

DEPLOYABLE SEATING ARRANGEMENT

BACKGROUND OF THE INVENTION

1. Field of the Invention

This invention relates generally to deployable seating arrangements having deployed and undeployed states, and more particularly, to a power deployed bleacher seating arrangement having nesting reinforced wheeled horse supports associated with each seating level, the horse supports being interlocked in the deployed state and sequentially delatched as the arrangement is restored to the undeployed state.

2. Description of the Related Art

Prior art seating arrangements, particularly of the deployable type, suffer from a number of significant disadvantages that cause operational problems, particularly during deployment and undeployment (i.e., restoration to an undeployed state). One problem associated with known deployable seating arrangements is binding that results from metal-on-metal contact. Such a binding between deployable seating rows is almost never symmetrical, whereby rows will bind at one end and not the other. This causes difficulty in achieving alignment during deployment and restoration to the undeployed state. The problem can sometimes be overcome by significantly increasing the power capacity of the drive motor, or increasing the number of motors, employed to move the rows. A known solution to this problem, therefore, requires additional cost and technical complexity, with an increased number of moving mechanical parts that are subject to failure.

Power drive arrangements that have been employed in conventional deployable bleacher seating arrangements have included frictional power systems having rollers centered under the first row. This allows the first row to rotate about the centered rollers, resulting angular misalignment. Once the first row becomes misaligned, it will urge subsequent rows into skewed misalignment. Often times, correction of misalignment will require restoration of the deployable seating arrangement to its original state and repeating the deployment or restoration procedure, as the case may be.

It is a further problem with known deployable seating arrangements that they are difficult and complicated to manufacture. Oftentimes, these arrangements are comprised of many small parts that are welded together, many such parts being mirror image (right-handed and left-handed) replications of each other. Such parts include, for example, gussets, bolsters, hinges, etc. In addition, the use of numerous parts that are not symmetrically shaped result in proliferation of the number of parts that must be assembled. This results in reduced production volume and difficulty in implementing automation. The incorporated additional operations, such as finishing and welding reduce the rate of production and increase costs. Moreover, additional labor is required not only to effect assembly, but also to create bills of materials, select materials for shipment, and assemble the product at the job site. The greater complexity that results from such a large number of parts increases the likelihood of errors in all operations.

Inflexibility in the rise and span of the deployable seating arrangements known in the art is yet another problem. Flexibility in rise and span is essential if the building codes of the various jurisdictions in which deployable seating products are installed are to be satisfied. Such building codes, may for example, require steps, such as provided in aisles, to be of uniform height, and it is often critical that the rise of such steps match the elevations of surrounding construction closely.

It is not uncommon in known deployable seating arrangements for the guide bars that couple the wheel channels together to bend. This results from rocking of the loaded arrangement back and forth, i.e., front to back. The main supports, called "horses" bear the stresses applied by the human load on the seating arrangement. In the present invention, guide bars having a cross-sectional diameter of ½" are used, as compared to convention guide bars having a cross-sectional diameter of ⅜".

In many known arrangements, those parts that are not welded to one another are bolted using nuts and bolts. Such nuts and bolts slow construction, as they comprise one more thing for the installer to handle. A second worker may be required to hold the nut on the back side while the bolts are installed. Such nuts, often are shaken loose and become temporarily lost during installation. The nuts, however, cause scratches and gouges on the floor as the deployable seating units are operated.

The structure of known deployable seating arrangements is also problematical. Standard 2½" spacing of support posts (horses) parallel to the seating results in the horses running out of space at the end of the section. This requires the construction of an expensive transition. However, such a transition also requires the dimension of the deployable seating arrangement, when closed, to be increased by some two to three feet. The known arrangements, therefore are not compact as they occupy undue floor space.

In conventional arrangements, the riser beams are urged tightly against the faces of the main support posts when the units are closed. There is, therefore, no place to run electrical wiring laterally to provide power at, and laterally beyond, wheel chair notches and truncations. Electrical cords get pinched as the units are telescoped closed. The riser beams, since they are very close to the faces of the main support posts, leave little or no room to bolt on a deck support bracket in the area occupied by the posts. This is particularly problematical when the units are telescoped closed, as the posts interfere with deck supports. A deck support bracket, however, is often necessary to support other options, such as aisle handrails and the front rails of a wheel chair notch.

A known arrangement employs multiple gussets in the understructure. Such gussets usually have sharp edges and appear as clutter, thereby diminishing the aesthetic appeal of the unit.

A further problem is present in known deployable seating arrangements, particularly at wheel chair notches and in pie-shaped sections. Additional hardware is required to replace the riser beam when it is omitted at such sections, to permit installation of row locks of the type that trip off of the first row riser beam.

In some known arrangements, horse weldments that carry the weight of the decking and seating as a cantilever deflect too greatly as the units are closed. This allows rubbing between rows which can damage the units and hinder their operation. Some of the deflection results from the fact that the support arms that cantilever from the main horse posts are not centered on the posts.

In known arrangements, the guide bars that attach the wheel channels together will become loosened after a period of time. This results from the metal tabs that retain them being repeatedly bent for removal during repair and maintenance.

There is additionally a need for an attachment arrangement for attaching the seating arrangement to a supporting wall, that is adjustable in all three dimensions. This will reduce installation difficulties, the number of required field modifications, and operational difficulties.

It is, therefore, an object of this invention to ameliorate the aforementioned problems and shortcomings of prior art deployable seating arrangements.

SUMMARY OF THE INVENTION

The foregoing and other objects are achieved by this invention which provides, in a first apparatus aspect thereof, a deployable seating arrangement having deployed and undeployed states. In accordance with the invention, there is provided a plurality of seating level members each having first and second ends and arranged in sequentially elevated relation to one another by a first predetermined height. Each such seating level member is disposed substantially directly beneath and immediately superior one of the seating level members in substantially stacked relation when the deployable seating arrangement is in an undeployed state. When the deployable seating arrangement is in a deployed state, each such seating level member is disposed beneath and forward of an immediately superior seating level member in stepped relation. Thus, the plurality of seating level members appear telescopically displaced with respect to each other when the deployable bleacher seating arrangement is in the deployed state. Further in accordance with this aspect of the invention, there is provided a plurality of L-shaped frame element each formed of vertical and horizontal portions coupled at respective ends thereof in an L-shape. Each of the L-shaped elements is coupled to an associated one of the plurality of the seating level members at respective locations thereon, with respect to a selected one of the first and second ends of an associated seating level member, whereby once deployable seating is in the undeployed state, the L-shaped frame elements are arranged directly vertically in relation to one another. A plurality of rollers, each coupled rotatively to a vertical portion of a respective one of the plurality of L-shaped frame elements is provided. Each such roller is arranged to communicate with a corresponding horizontal portion of an L-shaped frame element associated with a superior seating level member. In one embodiment, a driver arrangement is coupled to a predetermined one of the seating level members for urging the predetermined one of the seating level members between the deployed and undeployed states. There is additionally provided a plurality of wheeled frame arrangements each coupled to a respectively associated one of the plurality of seating level members and disposed laterally outward of the locations of the plurality of seating level members where the respective L-shaped frame elements are coupled. Each wheeled frame arrangement is arranged in accordance with a predetermined lateral spatial relationship with respect to a wheeled frame arrangement associated with another of the seating level members.

In one embodiment of the invention, each of the wheeled frame arrangements is arranged laterally inward of a wheeled frame arrangement associated with an immediately superior seating level member.

Each of the rollers that is coupled rotatively to the vertical portion of a respective one of the L-shaped frame elements is arranged to engage with the underside of the corresponding horizontal portion of the L-shaped frame element associated with a superior seating level member. Each of the rollers is provided with a protuberance in the form of a radially extended central portion for engaging with a corresponding depression in the underside of the corresponding horizontal portion of the L-shaped element associated with a superior seating level member. In this manner, the corresponding horizontal portion of the L-shaped frame element associated with a superior seating level member is retained in an engagement with each of the rollers, whereby the roller couples laterally to the immediately superior seating level. In an alternative embodiment, each of the rollers is provided with a radially extended lateral portion for defining a radially depressed central region of each of the rollers for accommodating there within the underside of the corresponding horizontal portion of L-shaped frame element associated with a superior seating level member. In this manner, the corresponding horizontal portion of the L-shaped frame element associated with a superior seating level member is retained in an engagement with each of the rollers.

In a further embodiment of the invention, there is provided a plurality of triangulation frame members, each of which is associated with a respective one of the plurality of seating level members for reducing sway of the deployable seating arrangement. Each of the plurality of triangulation frame members has first and second end portions, each of which is coupled at a first portion thereof to a selected one of the plurality of wheeled frame elements and at a second portion thereof to an associated seating level member. Each of the plurality of triangulation frame members is coupled at the second portion thereof to L-shaped frame element of the associated seating level member.

In a still further embodiment of this first apparatus aspect of the invention, there is provided a plurality of backstops, each of which is associated with a respective one of the plurality of seating level members. The backstops extend vertically upward for a distance that is responsive to the first predetermined height. Each of the backstops is coupled to the vertical portion of those of the L-shaped frame elements that are associated with the respective one of the plurality of seating level members.

With respect to the driver arrangement, there is provided a source of rotatory energy, which may be a motor. A traction system is coupled to the motor for applying a traction force to a surface, or floor, on which the deployable seating arrangement is disposed. In one embodiment, the traction arrangement is provided with first and second traction elements arranged on respective sides of the deployable seating arrangement, on either side of the motor, for preventing skewing of the various seating level members during deployment and undeployment of the deployable seating arrangement. Thus, the weight of the row itself is used to improve the traction that is available to the drive arrangement to apply power.

While in the undeployed state, there is provided a latch arrangement for latching a selective seating level member to a first adjacent seating level member. During the undeployment process, a sequential delatching arrangement delatches each seating level member. Delatching is effected sequentially in response to undeployment of a second adjacent seating level member. The latching arrangement, which includes in certain embodiments a gravity-actuated latching element installed on the selected seating level member is urged into a delatched position in response to the undeployment of the second adjacent seating level member. This is effected in some embodiments of the invention by a delatching protuberance on the second adjacent seating level member for communicating with the gravity-actuated latching element installed on the selected seating level member.

In accordance with a further apparatus aspect of the invention, there is provided a deployable seating arrangement having deployed and undeployed states. A plurality of seating level members, each having first and second ends, are arranged in sequentially elevated relation to one another by a first predetermined height, wherein a succeeding level member is disposed substantially directly beneath an immediately superior seating level member in substantially stacked relation when the deployable seating arrangement is in the undeployed state. Each such seating level member is disposed beneath and forward of an immediately superior seating level member in stepped relation when the deployable seating arrangement is in the deployed state. A plurality of frame elements are provided for supporting respectively associated ones of the plurality of seating level members and arranged directly vertically in communication with one another so as to be translatable with respect to each other during deployment and undeployment. A drive arrangement is coupled at a lowermost one of the seating level members for urging the lowermost one of the seating level members between the deployed and undeployed states. Additionally there is provided a plurality of wheeled frame arrangements each coupled to a respectively associated one of the plurality of seating level members. Each such wheeled frame arrangement is disposed laterally outward of the locations of the plurality of seating level members where the respective frame elements are coupled. Additionally, each wheeled frame arrangement is disposed in accordance with a predetermined lateral spatial relationship with respect to a wheeled frame arrangement associated with another of the plurality of seating level members.

In one embodiment of this further aspect of the invention, there is provided an electrical guide way that extends along at least one of the plurality of seating level members. Electrical conductors in the guide ways are directed around selected regions of the deployable seating arrangement, such as wheel chair notches and truncations, to supply electrical energy for the motors and control elements, as well as for lighting.

Each of the wheeled frame arrangements is arranged laterally inward of a wheeled frame arrangement associated with an immediately superior seating level member. Thus, when in an undeployed state the wheeled frame arrangements are nested within each other.

As previously noted, each roller of a plurality of rollers is coupled rotatively to a respective one of the plurality of frame elements. Each such roller is arranged to communicate with a corresponding frame element that is associated with a superior seating level member.

In a preferred embodiment, the frame elements are formed of vertical and horizontal portions that are coupled at respective ends to one another in an L-shaped configuration.

The drive arrangement is coupled to the lowermost one of the seating level members and includes a wide track drive. In such an arrangement, traction rollers are arranged in coaxial relation and at a distance from one another so as to reduce skewing and a misalignment problems. Power is delivered from a source of rotatory energy to the driver arrangement by any suitable mechanical power delivery arrangement. In one embodiment, a chain-type drive power delivery system is employed.

Each seating level has associated therewith a triangulation frame member. The triangulation frame member serves to reduce sway of the deployable seating arrangement. In some embodiments, more than one triangulation frame members are associated with the respective ones of the plurality of seating level members.

In a further embodiment of the invention, the plurality of seating level members, the plurality of frame elements, the driver arrangement and the plurality of wheeled frame arrangements are each associated with a forward portion of the deployable seating arrangement. There is additionally provided in this embodiment of the further aspect of the invention a rear portion of the deployable seating arrangement having a plurality of rear seating level members each having first and second ends and arranged in sequentially elevated relation to one another by a first predetermined height. Each such rear seating level member is disposed substantially directly beneath and immediately superior rear seating level member in substantially stacked relation when the deployable seating arrangement is in the undeployed state. Moreover, each such rear seating level member is disposed beneath and forward of an immediately superior rear seating level member in stepped relation when the deployable seating arrangement is in the deployed state. A plurality of rear frame elements is provided for supporting respectively associated ones of the plurality of rear seating level members. The rear frame elements are arranged directly vertically in communication with one another to be translatable with respect to each other during deployment and undeployment. A rear driver arrangement is coupled to a lowermost one of the rear seating level members for urging the lowermost one of the seating level members between the deployed and undeployed states. In addition, there is provided a plurality of rear wheeled frame arrangements each coupled to a respectively associated one of the plurality of rear seating level members. The rear wheeled frame arrangements are disposed laterally outward of the locations of the plurality of rear seating level members where the respective elements are coupled. Each such rear wheeled frame element is arranged laterally inward of a rear wheeled frame element associated with an immediately superior rear seating level member.

The rear seating level members have associated therewith a rear driver arrangement that includes a wide track rear driver arrangement. As previously discussed, a chain-type drive power delivery system is employed, in this embodiment to deliver mechanical energy from a source of rotatory motion, such as motor, to the rear drive arrangement. In addition, there is provided a plurality of first rear triangulation frame members each associated with a respective one of the plurality of rear seating level members for reducing sway of the deployable seating arrangement. Additionally, a plurality of second rear triangulation frame members, each associated with a respective one of the plurality of rear seating level members, further serves to reduce sway of the deployable seating arrangement.

A plurality of further rollers are each coupled rotatively to a respective one of the plurality of rear frame elements. Each such further roller is arranged to communicate with a corresponding rear frame element associated with a superior rear seating level member. Additionally, there are provided coupling means for coupling the lowermost one of the plurality of rear seating level members to an uppermost one of the plurality of seating level members. Thus, when the deployable seating arrangement is in the undeployed state, each such rear seating level member is disposed substantially directly beneath an immediately superior rear seating level member in substantially stacked relation to form a stack of rear seating level members. Simultaneously, each seating level member is disposed substantially beneath an immediately superior seating level member to form a stack of seating level members. The stack of seating level members is disposed forward of the stack of rear seating level members. During deployment of the deployable seating arrangement, the stack of seating level members is arranged to deploy prior to deployment of the stack of rear seating level members.

In accordance with a still further apparatus aspect of the invention there is provided a deployable seating arrangement having deployed and undeployed states. In accordance with the invention, a plurality of seating level members, each having first and second ends, is provided and arranged in sequentially elevated relation to one another by a first predetermined height. Each such seating level member is disposed substantially directly beneath an immediately superior seating level member in substantially stacked relation when the deployable seating arrangement is in the undeployed state. When in the deployed state, each such seating level member is disposed beneath and forward of an immediately superior seating level member in stepped relation. Each of the seating level members has associated therewith a frame element for supporting the associated seating level member. The frame element is arranged directly vertically in communication with other frame elements, and is translatable with respect to the other frame elements during deployment and undeployment. A wheeled frame arrangement is coupled to the seating level member and is disposed laterally outward of the frame element. The wheeled frame arrangement is arranged laterally inward of a wheeled frame arrangement associated with an immediately superior seating level member. There is additionally provided a triangulation frame member for reducing the sway of the deployable seating arrangement. The invention is further provided with a drive arrangement that is coupled to a predetermined one of the seating level members for urging the predetermined one of the seating level members between the deployed and undeployed states.

In one embodiment of this further aspect of the invention, the frame element is provided with vertical and horizontal portions coupled at respective ends thereof to one another to form an L-shape. The frame elements associated with the respective seating level members are arranged directly vertically in relation to one another. A roller is rotatively coupled to the vertical portion. Each of the rollers is arranged to communicate with a corresponding horizontal portion of an L-shaped frame element associated with a superior seating level member.

As previously described, a latching arrangement is provided for latching a seating level member while in the deployed state. During undeployment, the latching arrangements may, in one embodiment, be sequentially delatched.

In accordance with a still further apparatus aspect of the present invention, there is provided a deployable seating arrangement having deployed and undeployed states. A plurality of seating level members are provided each having first and second ends and arranged in sequentially elevated relation to one another by a first predetermined height. In this manner, each of the seating level members is disposed substantially directly beneath an immediately superior seating level member in substantially stacked relation when the deployable seating arrangement is in the undeployed state. When the arrangement is in the deployed state, each seating level member is disposed beneath and forward of an immediately superior seating level member in stepped relation therewith. Each seating level member has first and second seating level portions disposed axially with respect to each other. Each such seating level member is further provided with:

First and second nose beam portions associated with the first and second seating level portions, respectively; a nose beam splice coupler for coupling the first and second nose beam portions to one another;

First and second riser beam portions associated with the first and second seating level portions, respectively;

A riser beam splice coupler for coupling the first and second riser beam portions to one another; and A frame element for supporting the associated seating level member, the frame element being coupled to the nose beam splice coupler and to the riser beam splice coupler.

In one embodiment of this further aspect of the invention, there are provided first and second electrical conduits for guiding electrical wiring on a back side of the first and second riser beam portions respectively. The first and second electrical conduits are substantially in axial registration with one another.

In a further embodiment there are provided first and second driver arrangements coupled to a lowermost one of the seating level members for urging the lowermost one of the seating level members between the deployed and undeployed states. The first and second driver arrangements are disposed axially with respect to each other and associated with the first and second seating level portions, respectively. The first and second driver arrangements, in one embodiment, are first and second wide track power systems, respectively. Each of these wide track power systems may be powered by a chain drive system that derives energy from a source of rotatory power.

The deployable seating arrangement of this further aspect of the invention is provided with, as previously discussed, a wheeled frame arrangement that is coupled thereto and disposed laterally outward of the frame element. The wheeled frame arrangement is arranged laterally inward of a wheeled frame arrangement associated with an immediately superior seating level member. Additionally, a triangulation frame member is provided to reduce the sway of the deployable seating arrangement. In some embodiments, a further triangulation frame member is provided to reduce further the sway of the deployable seating arrangement. A guide arrangement on the wheeled frame arrangement maintains a predetermined spatial relationship between adjacent wheeled frame arrangements during deployment and on deployment. The guide arrangement may constitute in some embodiments a longitudinal guide element and an engagement element for engaging with the longitudinal guide element of an adjacent wheeled frame arrangement.

Further in regard of this aspect of the invention, there are further provided a plurality of L-shaped elements each formed of vertical and horizontal portions coupled at respective ends thereof to one another in an L-shape. Each of the L-shaped frame elements is coupled to an associated one of the plurality of seating level members at respective locations thereon with respect to a selected one of the first and second ends of an associated seating level member. In this manner, when the deployable seating arrangement is in the undeployed state, the L-shaped frame elements are arranged directly vertically in relation to one another. Additionally, there are provided a plurality of rollers, each being coupled rotatively to a vertical portion of a respective one of the plurality of L-shaped frame elements. Each such roller, as previously described, is arranged to communicate with a corresponding horizontal portion of an L-shaped frame element associated with a superior seating level member.

BRIEF DESCRIPTION OF THE DRAWINGS

Comprehension of the invention is facilitated by reading the following detailed description, in conjunction with the annexed drawing, in which.

DETAILED DESCRIPTION

Figure 1:
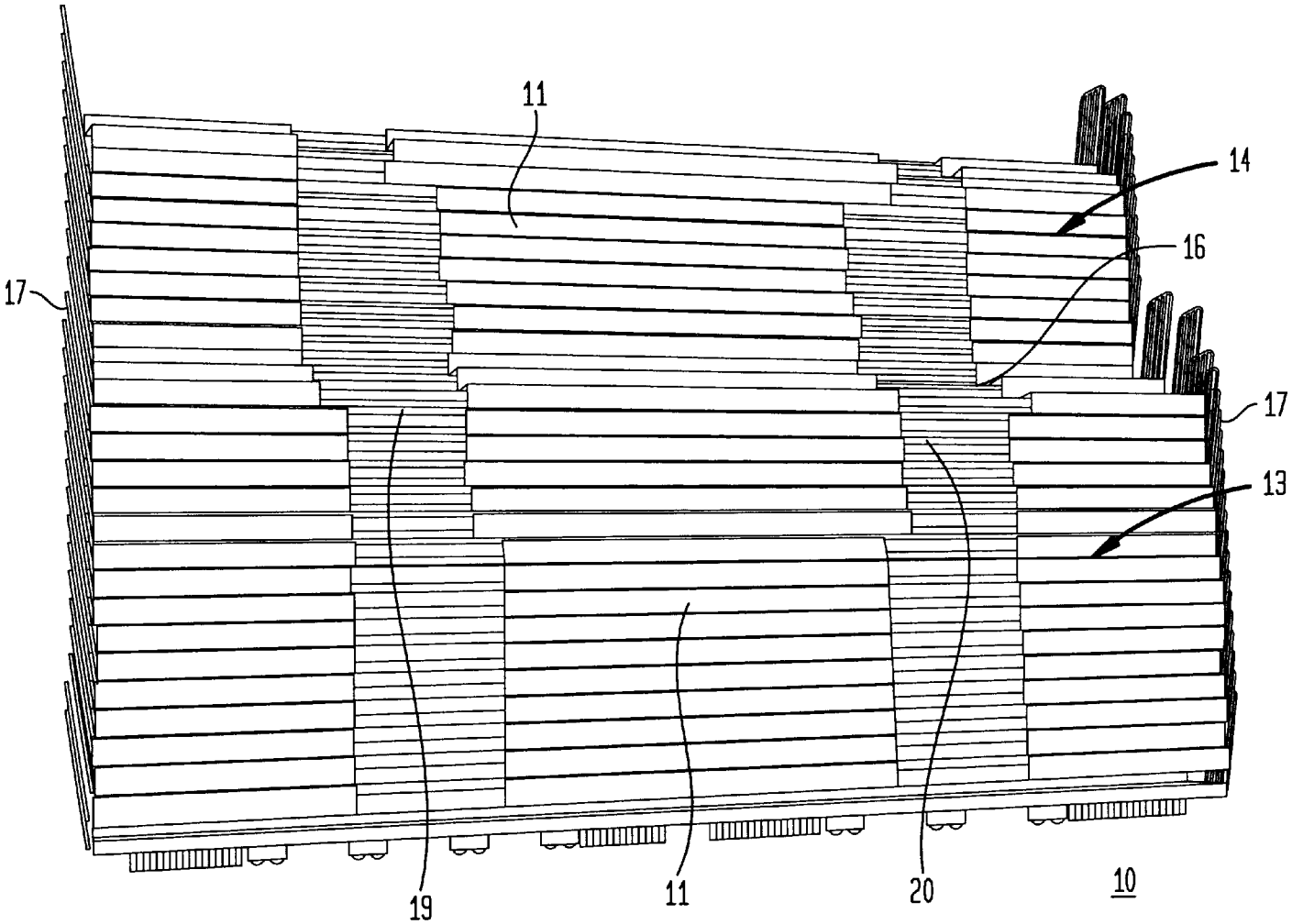
FIG. 1 is a perspective representation of a deployable seating arrangement constructed in accordance with the principles of the invention, shown in an undeployed state.

FIG. 1 is a perspective representation showing a specific illustrative embodiment of a deployable seating arrangement 10 seen in an undeployed state. As shown in this figure, deployable seating arrangement 10 is formed of a plurality of seating level members 11 that are shown to be substantially in stacked relation with respect to one another.

FIG. 1 additionally shows seating level members 11 to form, in this specific illustrative embodiment of the invention, two seating level portions, specifically a first seating level portion 13 which is formed of lower ones of the seating level members, and a second seating level portion 14 that is comprised of the upper seating level members. The first and second seating level portions are distinguished at a dividing seating level member 16 which, as will be shown hereafter, extends forward of the stacked second seating level portion 14 and in this embodiment is provided with an associated drive arrangement.

Figure 2:
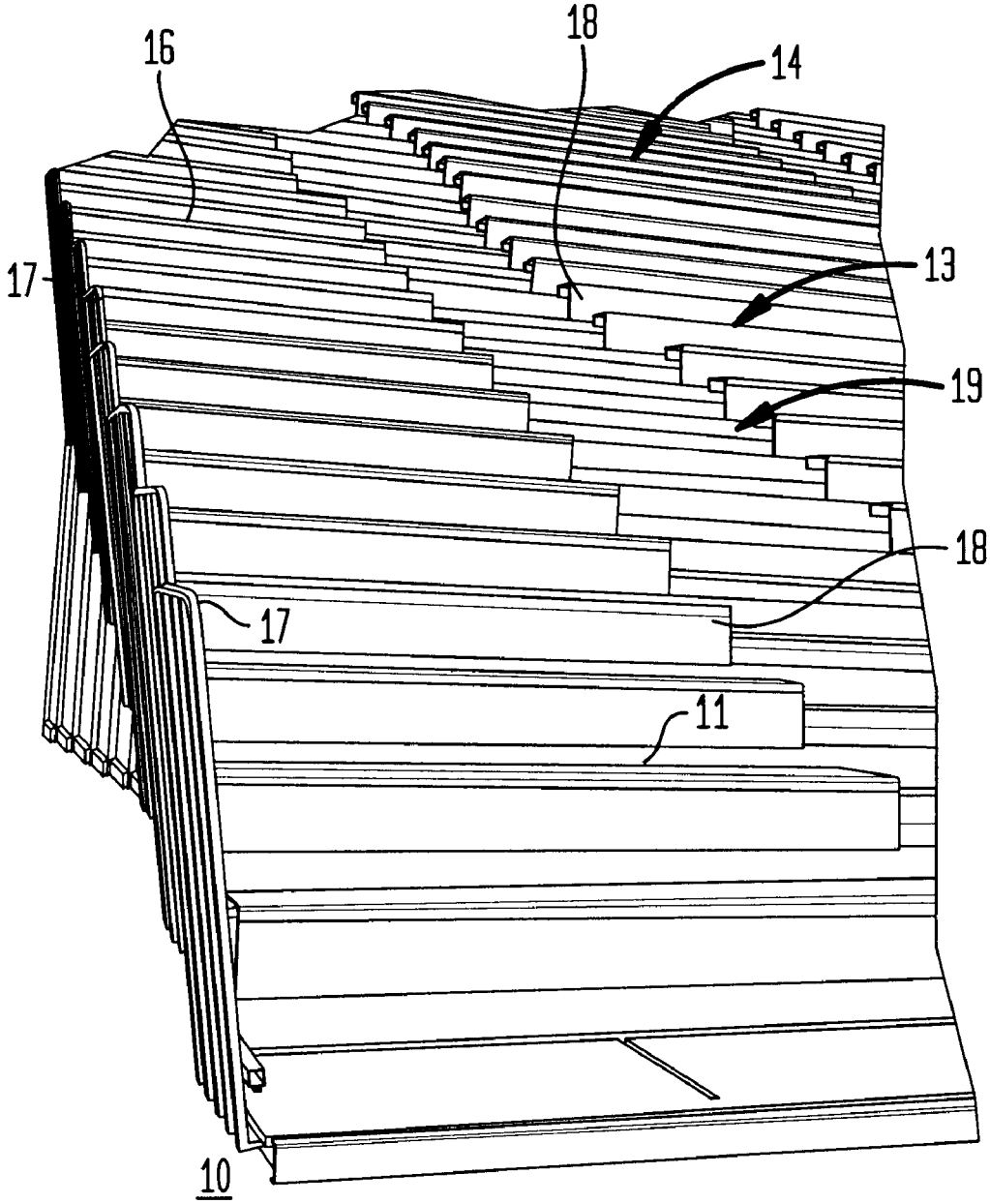
FIG. 2 is a perspective representation of the deployable seating arrangement of FIG. 1 in a deployed state.

FIG. 2 is a perspective representation of deployable seating arrangement 10 shown in a deployed state. Elements of structure that have previously been discussed are similarly designated. FIG. 2 shows first seating level portion 13 deployed forward of second seating level portion 14. Each of seating level members 11 has associated therewith one of a plurality of nesting guardrails 17. The nesting guardrails serve an essential safety purpose in preventing accidents and, as shown in FIG. 1 are oriented to extend outwardly from the rear and from the top, whereupon the nesting guardrails, when deployable seating arrangement 10 is in an undeployed state will be disposed substantially vertically, one above the other.

Figure 3:
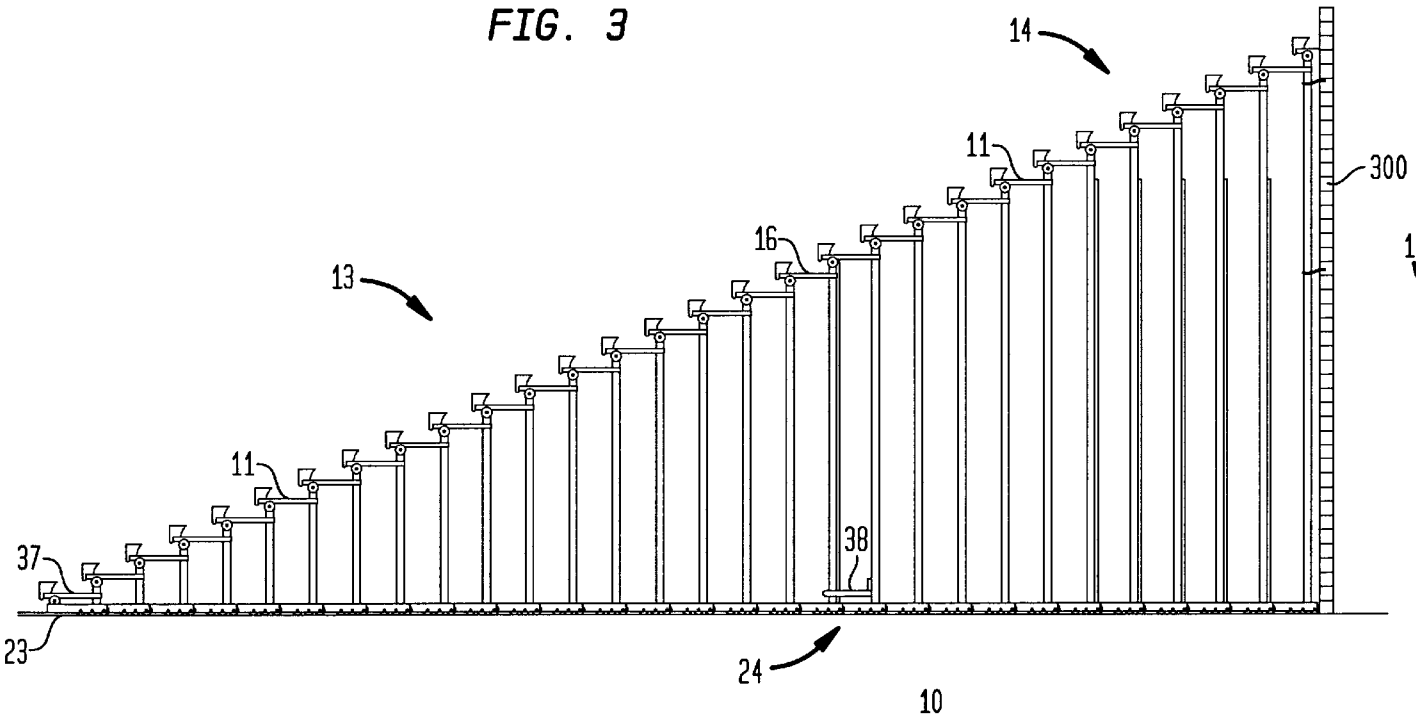
FIG. 3 is a simplified schematic side representation of a deployable seating arrangement in a deployed state.

Referring once again to FIG. 2, and as will be seen in FIG. 3, dividing seating level 16, which separates the first and second seating level portions from one another, is configured so as not to be displaceable further outward of the second seating level portion, thereby creating a continuous sequence of similarly sized steps along an aisle 19 of the deployable seating arrangement after deployment of the deployable seating arrangement. In this embodiment of the invention, two such aisles, 19 and 20 are included in the deployable seating arrangement. Aisle 20 is not visible in FIG. 2.

As noted, the regions for accommodating seated persons on either side of the aisles are provided with seating units 18. Various forms and embodiments of seating units 18 will be discussed herein below with respect to FIGS. 25 to 28. In addition, specific details of nesting guardrails 17 and associated structure for mounting same will be described herein below with respect to FIGS. 29 to 31.

FIG. 3 is simplified schematic side representation of a deployable seating arrangement 10 seen in a deployed state. This figures illustrates the continuous step-like manner in which seating level members 11 continue uniformly from first seating level portion 13 to second seating level portion 14, on either side of dividing seating level 16.

Figure 4:
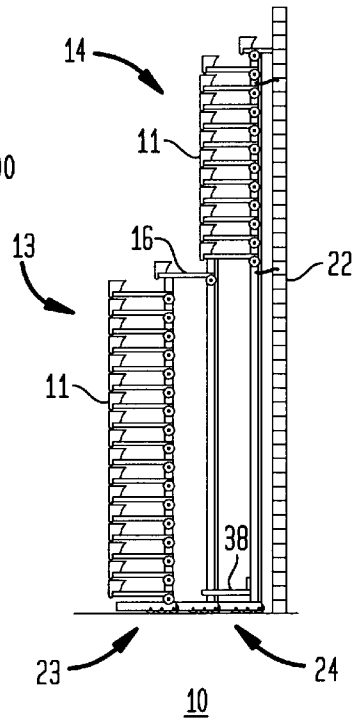
FIG. 4 is a simplified schematic side representation of the deployable seating arrangement of FIG. 3 in an undeployed state.

FIG. 4 is a simplified schematic side representation of the deployable seating arrangement of FIG. 3, shown in an undeployed state. As shown in this figure, first seating level portion 13 has its associated seating level members 11 arranged in stacked relationship beneath dividing seating level 16. Similarly, second seating level portion 14 has its associated seating level members arranged in stacked relation offset further back from those of the first seating level portion. A back wall 22 is disposed in the rearmost region of second seating level portion 14.

Figure 5:
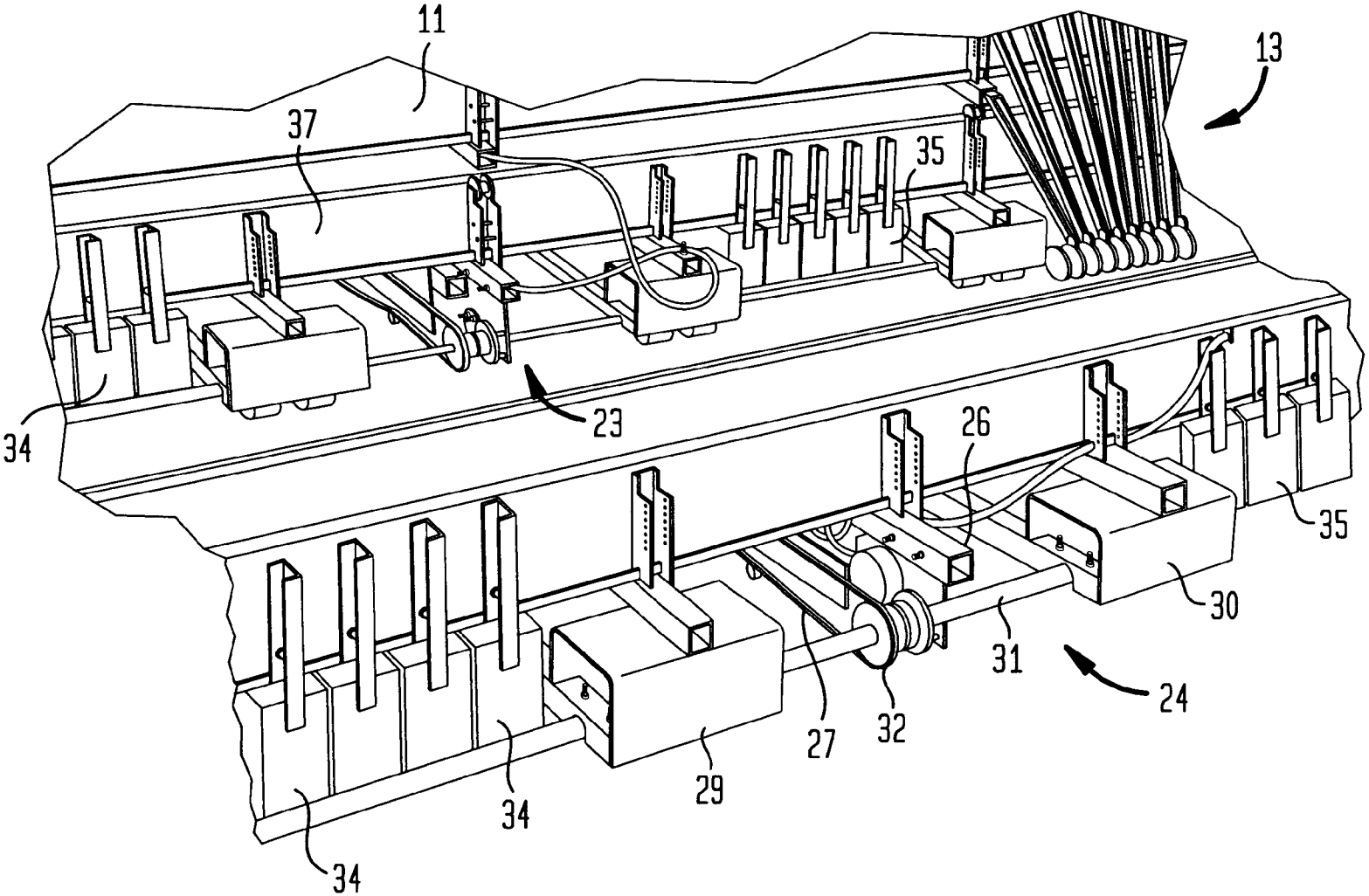
FIG. 5 is a perspective representation of the deployable seating arrangement of FIG. 1 as seen from underneath showing first and second drive arrangements.

FIG. 5 is a perspective representation of deployable seating arrangement 10 of FIG. 1 seen from underneath to show a first drive arrangement 23 and a second drive arrangement 24. In this embodiment of the invention, the first and second drive arrangements are similar to one another, and each is provided with a motor 26 that is coupled to a respective chain drive 27. The chain drive delivers rotational energy to traction rollers 29 and 30 via a coupling shaft 31 that is coupled to the chain drive by a sprocket 32. Traction rollers 29 and 30 are shown to be distal from one another on opposite sides of drive motor 26 and chain drive 27 so as to form a wide track traction arrangement that reduces the likelihood of skewing and misalignment during deployment and undeployment of the deployable seating arrangement, as will be described herein below referring for the moment to FIG. 4, first drive arrangement 23 is arranged directly beneath the stack of seating level members 11 that form first seating level portion 13. Second drive arrangement 24 is disposed beneath those seating level members that form second seating level member 14 the location of first and second drive arrangements 23 and 24 upon deployment of the deployable seating arrangement is shown in FIG. 3.

Referring once again to FIG. 5, it is seen that first and second drive arrangements 23 and 24 are installed on a first seating level member 37 of first seating level portion 13 and a support base 38 that support second seating level portion 14, respectively. In order to improve traction over that which is available with the use of the weight of the row itself, first seating level member 37 and support base 38 are provided with weights 34 and 35, which may be formed of concrete. As shown, weights 34 and 35 are disposed on opposite sides of the respectively associated ones of first drive arrangement 23 and second drive arrangement 24.

Figure 6:
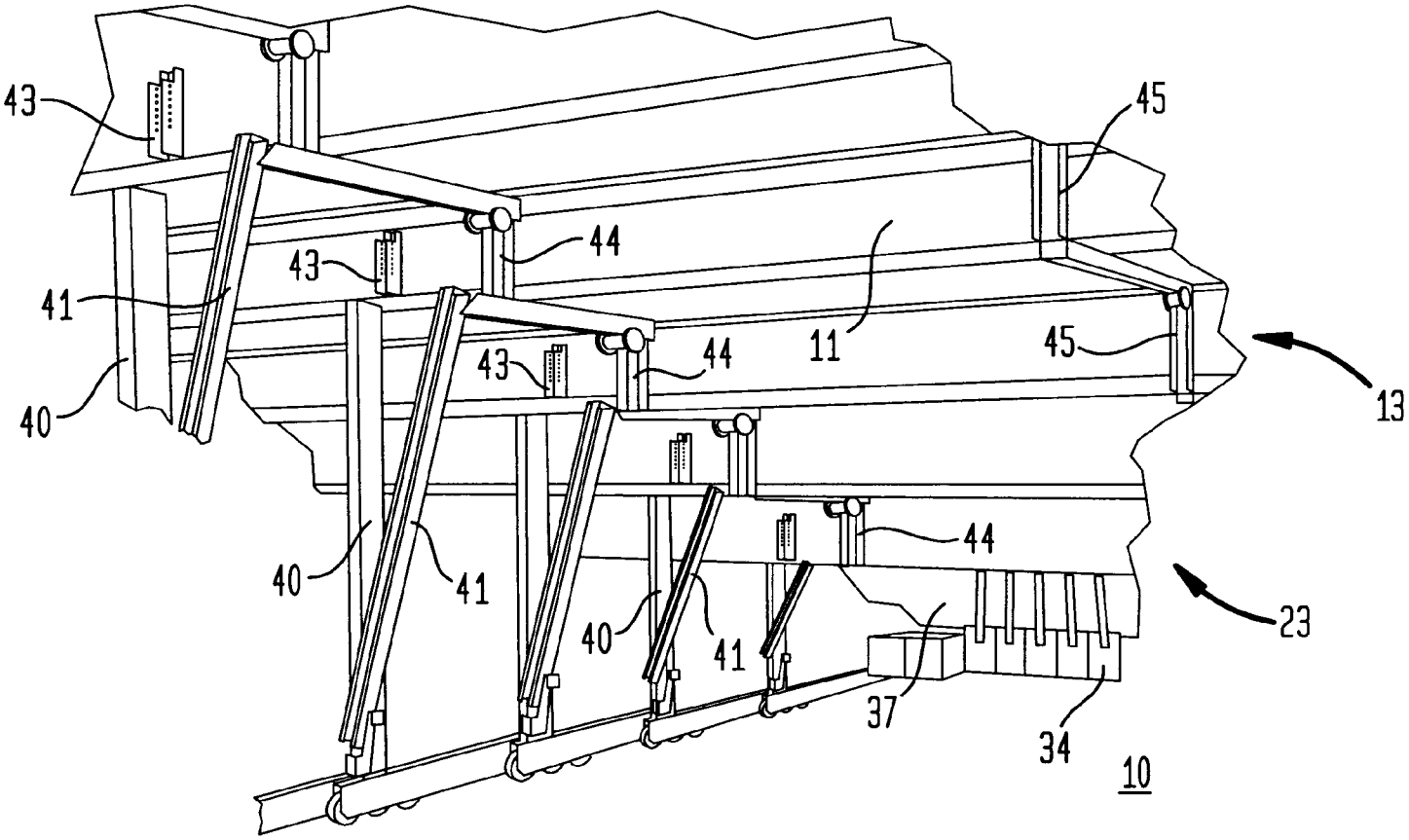
FIG. 6 is a perspective representation of the deployable seating arrangement of FIG. 1 seen from underneath showing the deployable seating arrangement in a deployed state as well as underlying structure in the form of wheeled frame elements and triangulation members.

FIG. 6 is a perspective representation of deployable seating arrangement 10 seen from underneath to show certain elements of structure previously discussed, as well as other items of structure. This figure shows, for example, a plurality of wheeled frame elements 40 each associated with a respective one of seating level members 11 of first seating level portion 13. Structural rigidity is enhanced by using a plurality of associated triangulation members 41 that interconnect the wheeled frame elements to respectively associated ones of seating level members 11, as follows: each of the seating level members is shown in this embodiment to have an associated one of first L-shaped frame elements 43 coupled thereto. As will be discussed herein below with respect to FIGS. 22 and 23, the first L-shaped frame elements support the respectively associated seating level members atop a respectively associated one of wheeled frame elements 40. Each seating level member 11 is further provided with a second L-shaped frame element 44 arranged at distance inward from first L-shaped frame element 43. A triangulation member 41 couples each of the second L-shaped frame elements to it respectively associated wheeled frame element. The triangulated configuration improves rigidity of the overall deployable seating arrangement and reduces swaying under load. In the practice of the invention, additional L-shaped frame elements may be provided such as third L-shaped frame elements 45 in the region of the center of the seating level members.

Figure 7:
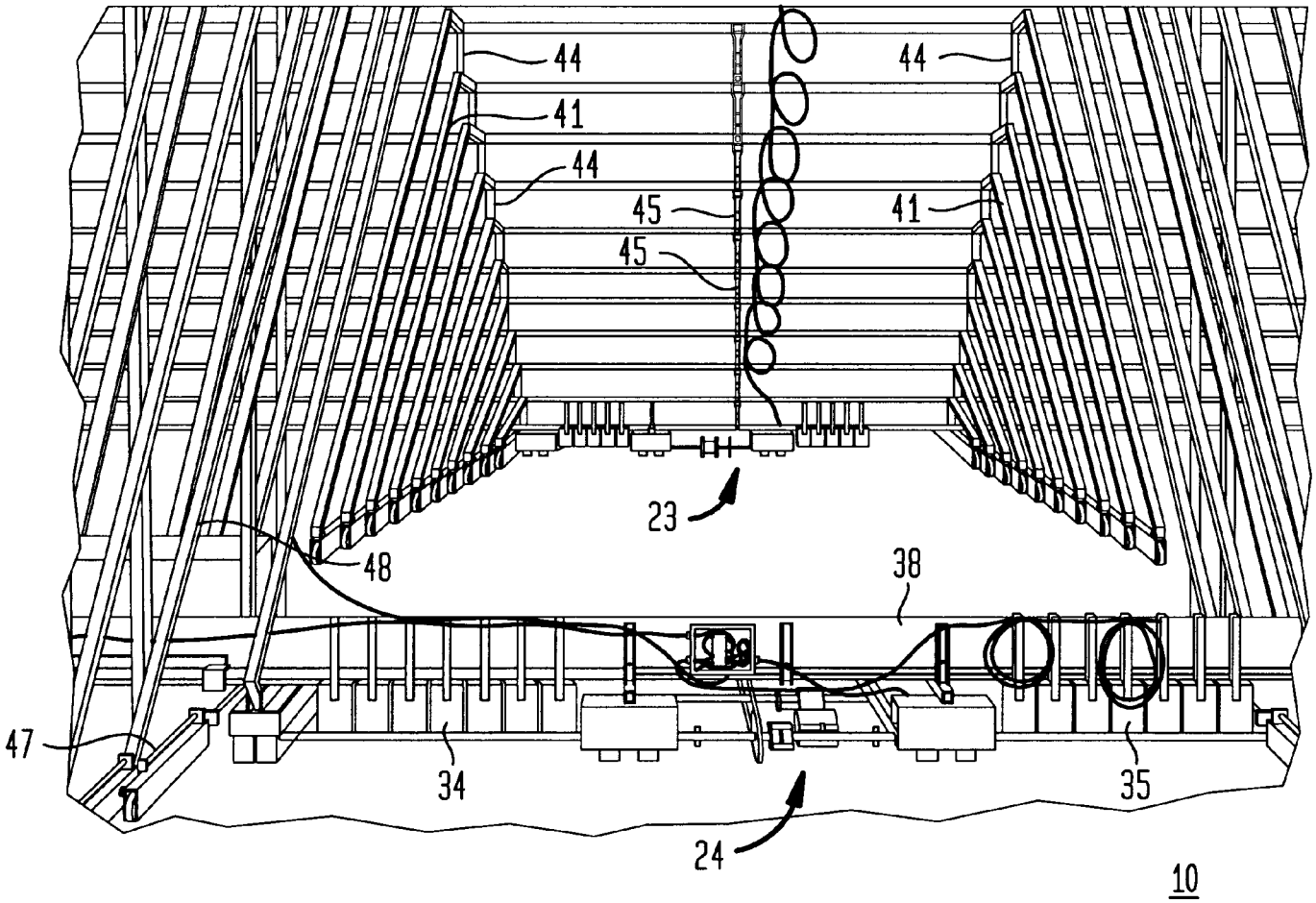
FIG. 7 is a perspective representation of the embodiment of FIG. 1 seen from underneath in a deployed state showing a rear drive arrangement and a plurality of wheeled frame arrangements and triangulation members.

FIG. 7 is a perspective representation of deployable seating arrangement 10 as seen deployed from underneath. This figure shows a symmetrical array of triangulation members 41 on both sides of center. Additionally, there is shown a plurality of rear wheeled frame elements 47 arranged in the second seating level portion with respective ones of rear triangulation members 48 arranged to couple the rear wheeled frame elements to respectively associated seating levels of the second seating level portion.

Figure 8:
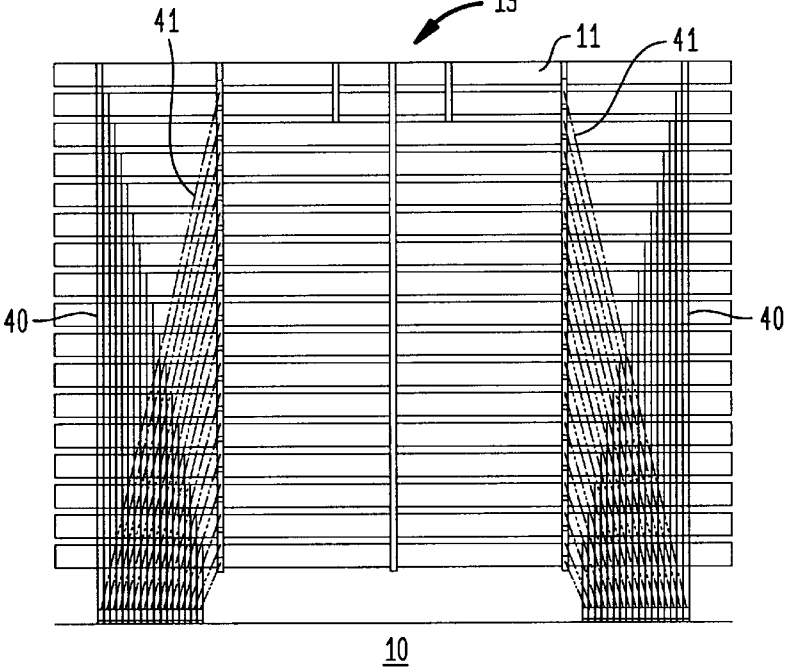
FIG. 8 is a simplified schematic representation of a first portion of a deployable seating arrangement showing wheeled frame elements arranged in sequentially nested condition and nested triangulation frame members.

FIG. 8 is a simplified schematic representation of first seating level portion 13 of deployable seating arrangement 10 showing the symmetrical arrangement of wheeled frame elements 40 and correspondingly associated triangulation members 41. As shown, triangulation members 41 coupled respectively associated ones of wheeled frame elements 40 to respective seating level members 11.

Figure 9:
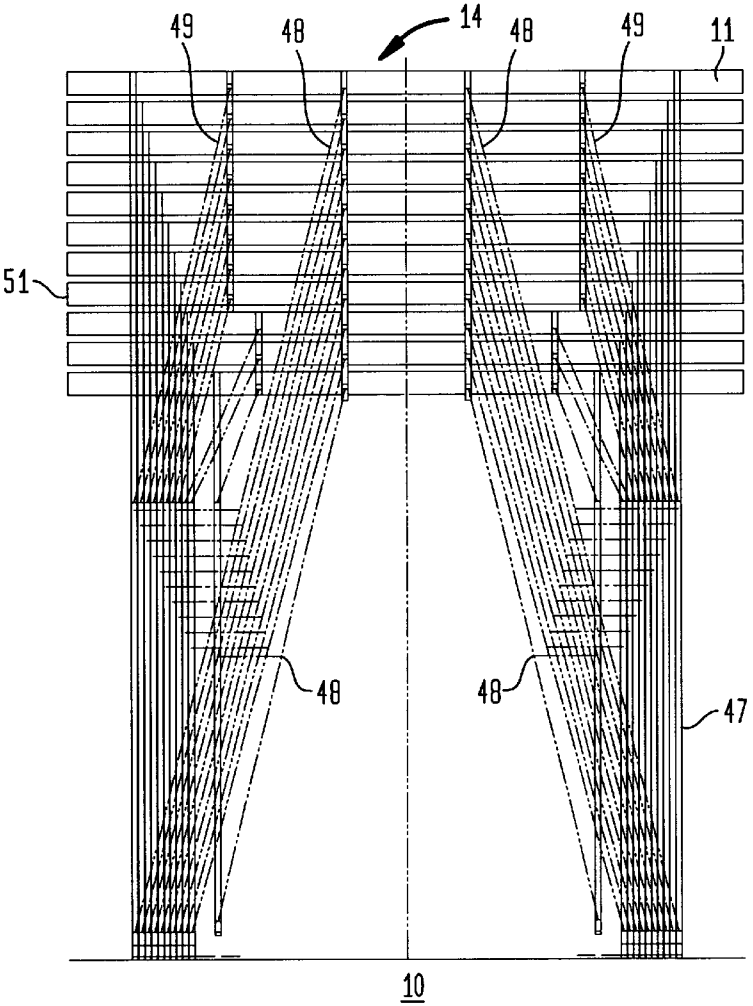
FIG. 9 is a simplified schematic representation of a second (rear) plurality of nested wheeled arrangements showing nested triangulation members and further triangulation members.

FIG. 9 is a simplified schematic representation of second seating level portion 14 of deployable seating arrangement 10 showing rear wheeled frame elements 47 in a symmetrical arrangement with rear triangulation members 48 that couple to respective ones of seating level members 11. In addition, this figure shows a plurality of further rear triangulation members 49 whereby certain ones of seating level members 11 of second seating level portions 14, such as seating level member 51 is coupled to corresponding ones of rear wheeled frame elements 47 by respectively associated ones of rear triangulation members 48 and further rear triangulation members 49. The use of multiple triangulation members in the upper seating level members diminishes sway under load and enhances structural rigidity.

Figure 10:
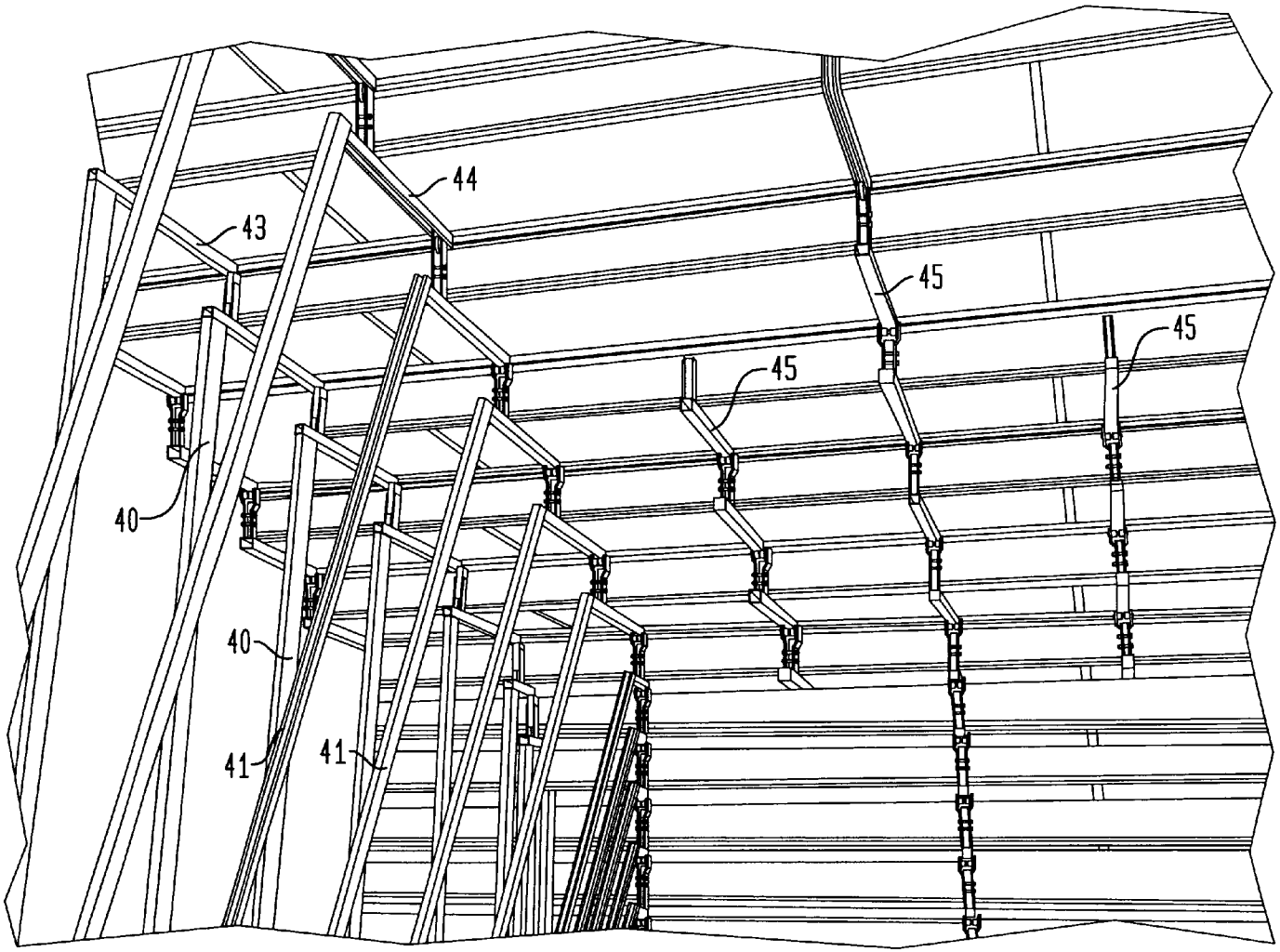
FIG. 10 is a perspective representation of the deployable seating arrangement of FIG. 1 seen from underneath in a partially deployed condition showing interconnection of triangulation members to L-shaped arrangements, as well as vertically arranged pluralities of L-shaped arrangements.
Figure 11:
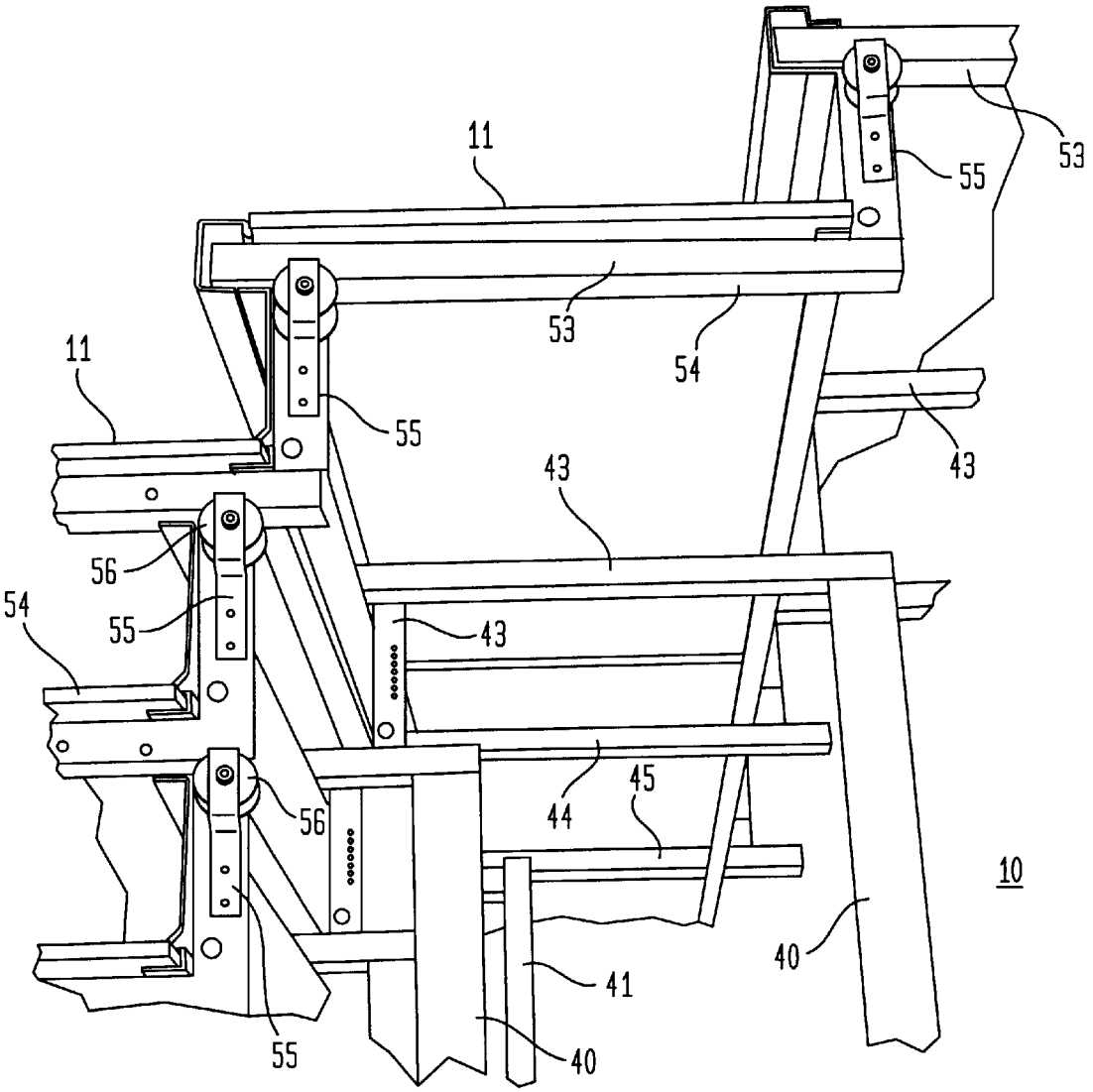
FIG. 11 is a perspective side representation of the deployable seating arrangement of FIG. 1 in a partially deployed condition showing a plurality of vertically stacked L-shaped members with rollers thereon supporting immediately superior ones of the L-shaped members.

FIG. 10 is a perspective representation of deployable seating arrangement 10 seen from underneath in the condition of partial deployment. This figure shows the spatial relationship between first L-shaped frame elements 43, second L-shaped framed elements 44, and third L-shaped frame elements 45. As is additionally shown in FIG. 11, each seating level member 11 has an associated fourth L-shaped frame element 53 associated therewith at each respective end (only one end shown in this figure). As can be seen in this figure, each of the L-shaped frame elements has a horizontal portion 54 and a vertical portion 55. A roller 56 is rotatably affixed to an end of vertical portion 55 and is arranged to support horizontal portion 54 of an immediately superior corresponding L-shaped frame element.

Figure 12:
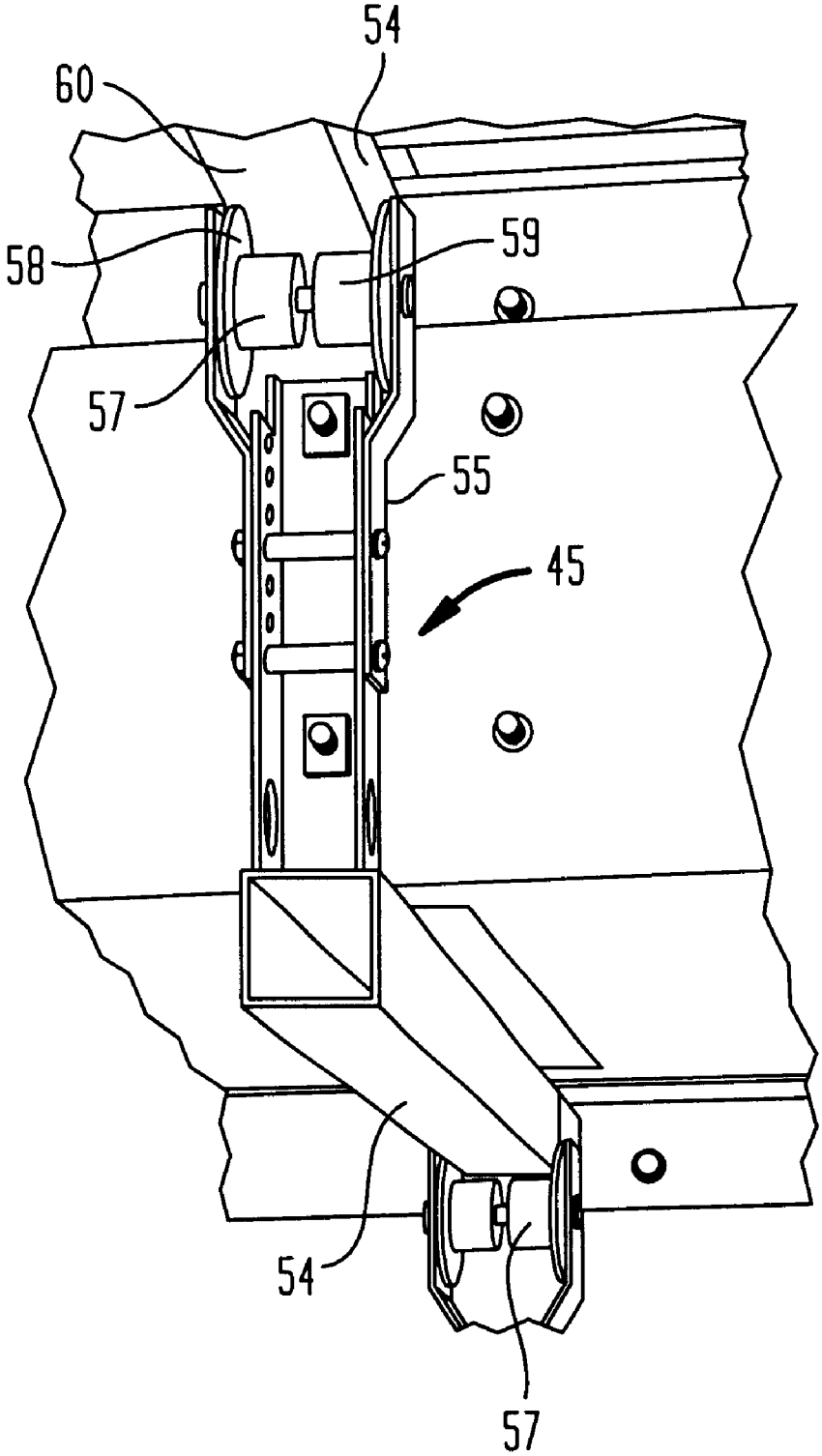
FIG. 12 is a perspective representation of an L-shaped member and a centrally indented roller thereon.

FIG. 12 is a perspective representation showing the detail of an illustrative L-shaped frame element 45. The figure shows a horizontal portion 54 coupled to a vertical portion 55 to form the L-shaped frame element. A roller 57 is rotatably attached at the distal end of vertical portion 55 from the end where it is coupled to horizontal portion 54. In this specific embodiment, roller 57 is shown to have a flange 58, in the form of a radially extended lateral portion, so as to produce a radially diminished portion 59 wherein is accommodated the underside 60 of the horizontal portion 54 of the immediately superior L-shaped frame element. In this embodiment, therefore, horizontal portion 54 has a flat underside that communicates with radially diminished portion 59. In this manner, the corresponding horizontal portion of the L-shaped frame element associated with a superior seating level member is retained in an engagement with each of the rollers, whereby the roller couples laterally to the immediately superior seating level.

Figure 13:
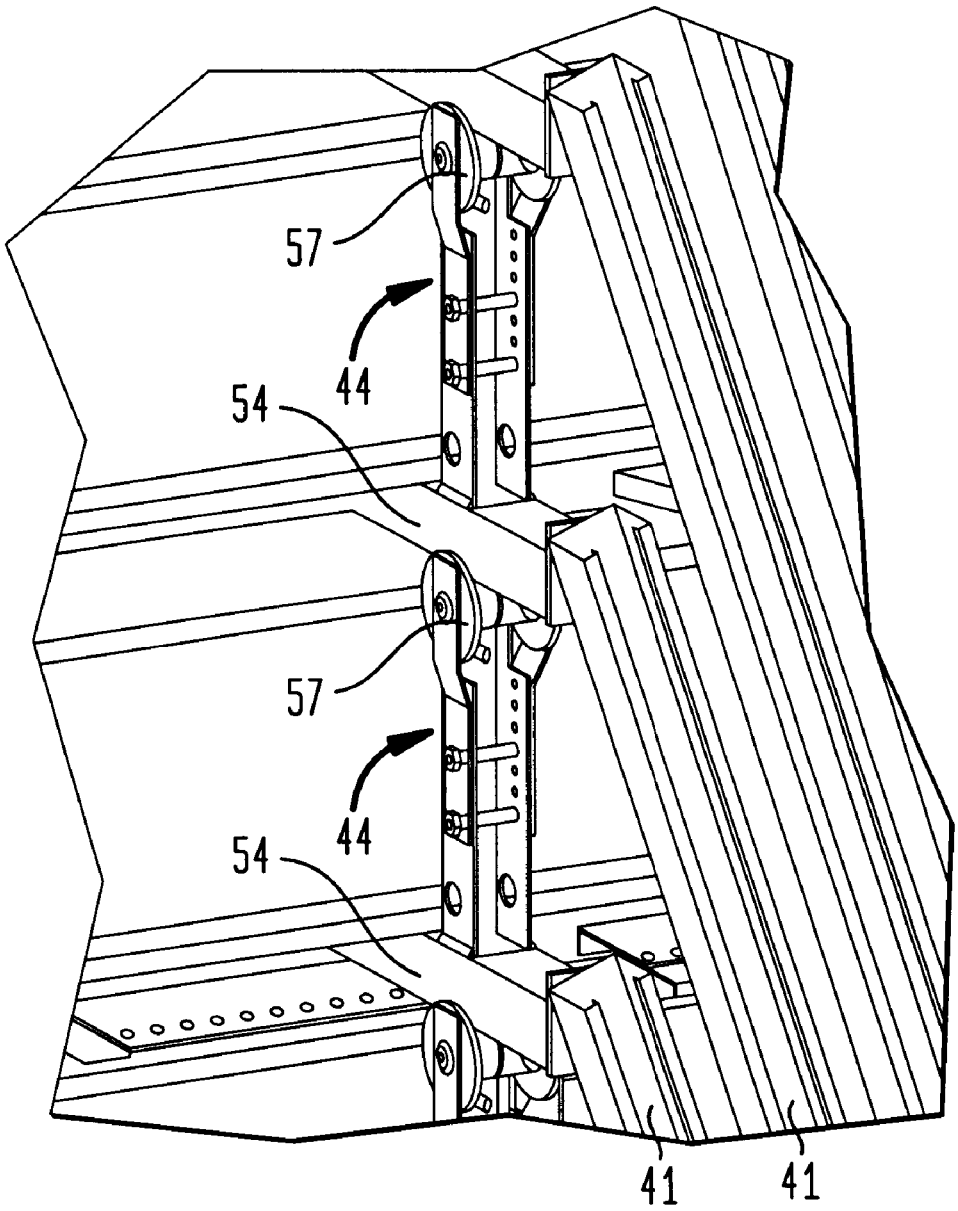
FIG. 13 is a perspective representation of a plurality of L-shaped members showing in detail the connection thereto of triangulation members.

FIG. 13 is a perspective representation showing the plurality of stacked second L-shaped frame elements 44 with respective ones of triangulation members 41 coupled at end portions thereof. Second L-shaped frame elements 44 are shown to have extended horizontal portions 54 to coupling of the associated triangulation members without the triangulation members interfering with rollers 57. In this embodiment, rollers 57 are identical to those described herein above with respect to FIG. 12.

Figure 14:
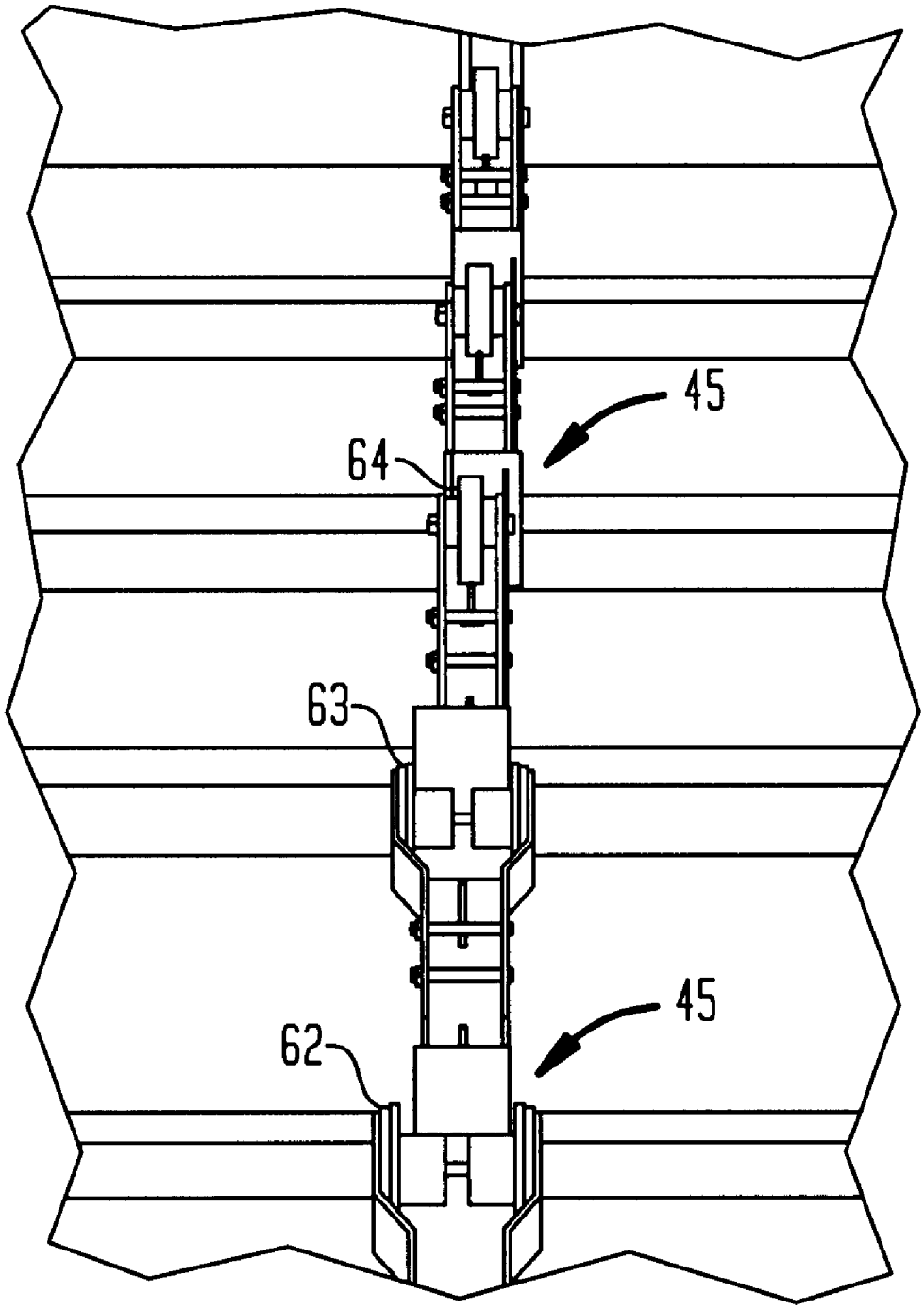
FIG. 14 is a perspective representation of a plurality of vertically stacked L-shaped members having various forms of rollers thereon.

FIG. 14 is perspective representation showing a plurality of stacked L-shaped frame elements 45 having different styles of rollers installed on the respective vertical portions. More specifically, rollers 62 and 63 are shown to have radially extended lateral portions, or flanges, as described herein above with respect to FIG. 12. Roller 64, however, is radially enlarged in the central region thereof so as to engage in an elongated depression or opening in the underside of the horizontal member of the immediately superior L-shaped frame element, as will be discussed herein below with respect to FIGS. 15 and 16.

Figure 15:
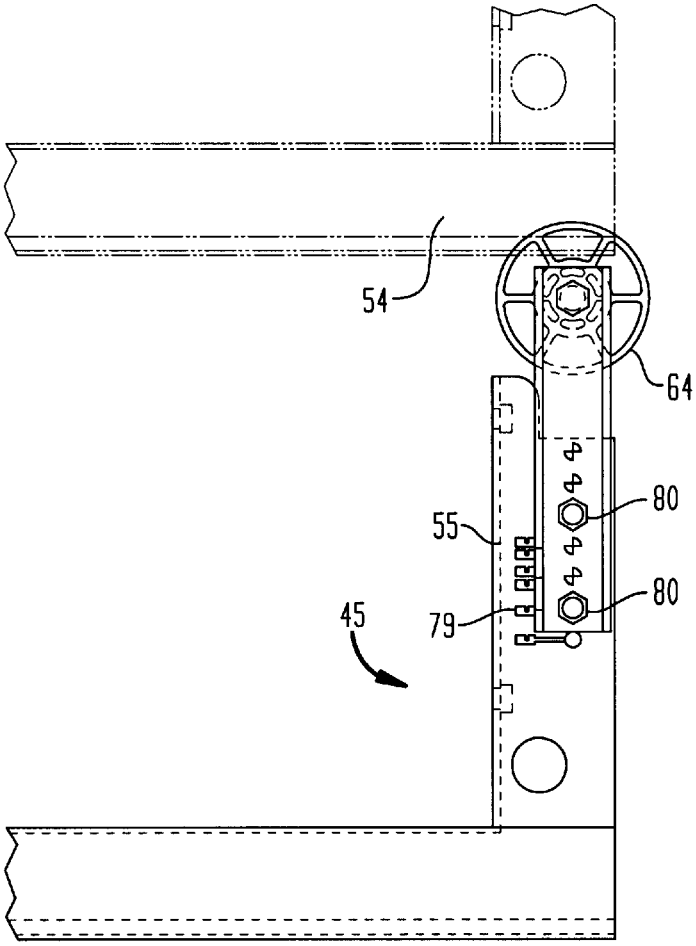
FIG. 15 is a simplified schematic representation of a detail of an L-shaped member showing a roller on a vertical portion thereof supporting an immediately superior L-shaped member.

FIG. 15 is a simplified schematic representation of a vertical portion 55 of a third L-shaped frame element 45 having a roller 64 rotatably coupled thereto so as to engage with the underside of a horizontal portion 54 of an immediately superior L-shaped frame element (shown in phantom).

Figure 16:
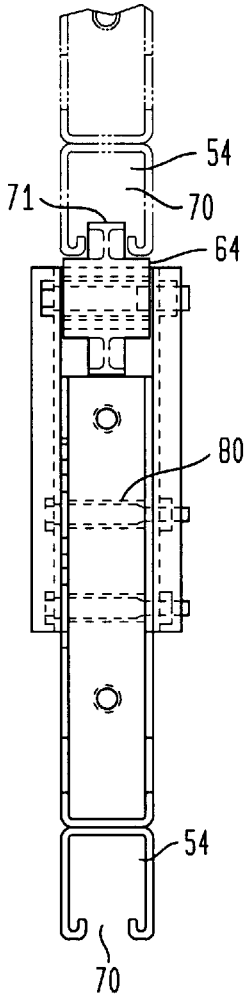
FIG. 16 is a simplified schematic representation showing an end view of the embodiment of FIG. 15 further showing the end view of a horizontal portion of L-shaped member arranged to receive a radially extended central portion of a roller.

FIG. 16 is an end view of the embodiment of FIG. 15 showing that each of horizontal portions 54 has an elongated depression in the form of an elongated opening 70 that accommodates radially enlarged portions 71 of roller 64. The use of the radially enlarged portion 71 engaged with elongated opening 70, or flange 58 (FIG. 12) insures that the stacked L-shaped frame elements will not accidentally become laterally disengaged during deployment and undeployment of the deployable seating arrangement. The rollers transfer lateral (i.e., axial with respect to the seating levels) loads between rows. Sway braces corresponding to a row of seats are attached to the frame of the row below, as discussed herein.

Figure 17:
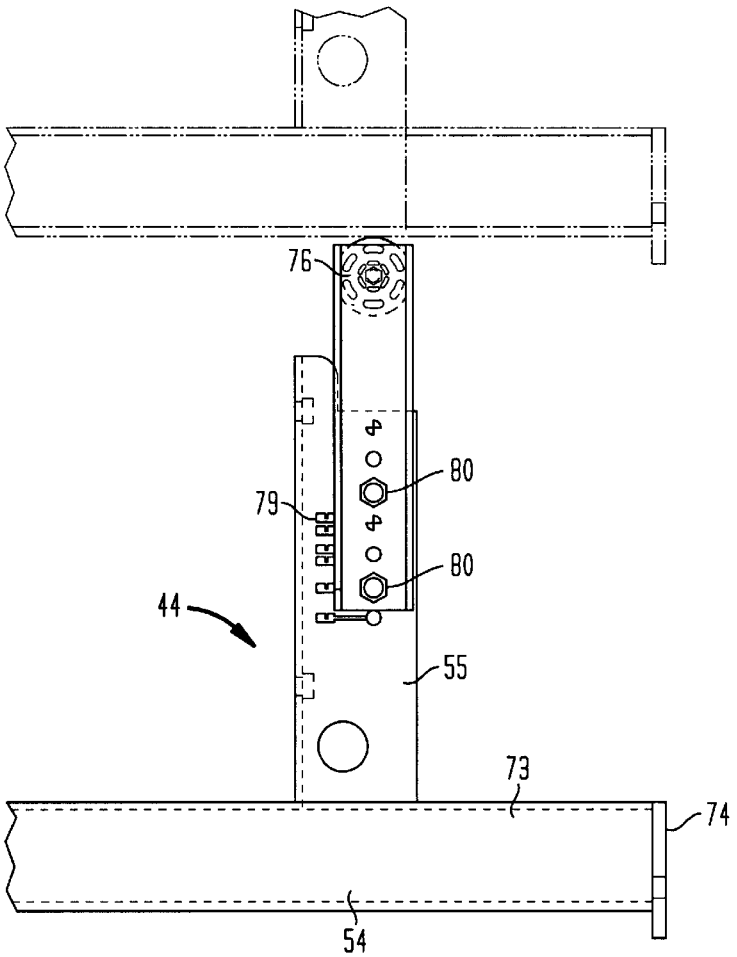
FIG. 17 is a simplified schematic representation of an L-shaped member with a roller disposed on a vertical portion thereof.

FIG. 17 is a simplified schematic representation of a second L-shaped frame element 44 having an elongated horizontal portion 54 so as to be provided with a rearward extension 73, the end portion thereof (not shown in this figure) being adapted to be coupled to a triangulation member (not shown in this figure) as previously described. A vertical portion 55 extends upward with cylindrical roller 76 being rotatably affixed at the upward end thereof.

Figure 18:
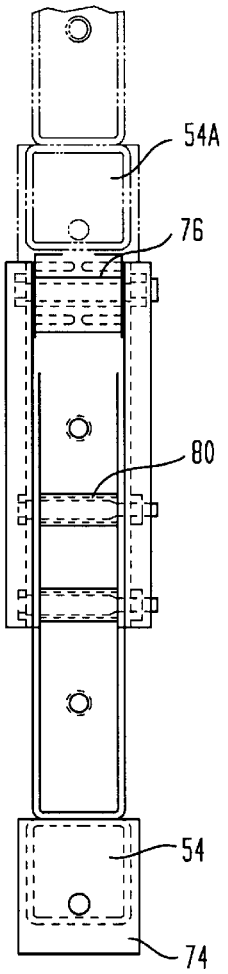
FIG. 18 is simplified schematic representation of an end view of the embodiment of FIG. 17.

FIG. 18 is simplified schematic representation of the embodiment of FIG. 17. This figure shows cylindrical roller 76 communicating with the underside of horizontal portion 54*a* of an immediately superior L-shaped frame element.

It is to be noted with respect to FIGS. 15–18, for example, that the riser portions are adjustable to achieve a desired one of a variety of riser heights. Such adjustability of riser height is achieved by using a desired combination of bolt holes 79 with bolts 80.

Figure 19:
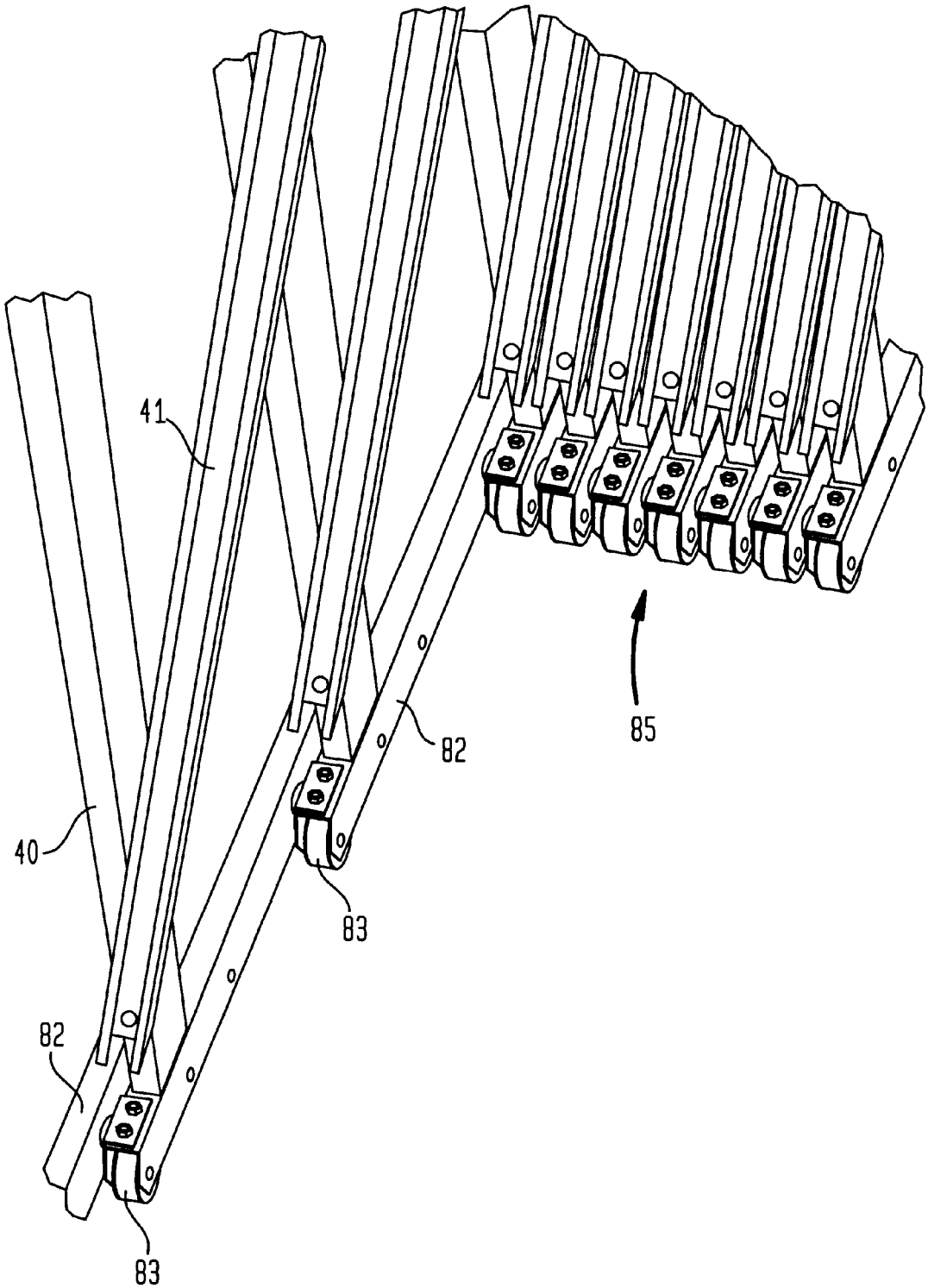
FIG. 19 is a perspective representation of a plurality of wheeled frame arrangements showing triangulation members coupled thereto, the wheeled frame arrangements being arranged in sequentially nested relation.

FIG. 19 is a perspective representation showing wheeled frame elements 40 in greater detail so as to show respectively associated wheel base portions 82 thereof, each having a plurality of wheels 83. This figure additionally shows that wheeled frame elements 40, and there respectively associated roller based portions nest side by side in the undeployed state, as shown in undeployed region 85.

Figure 20:
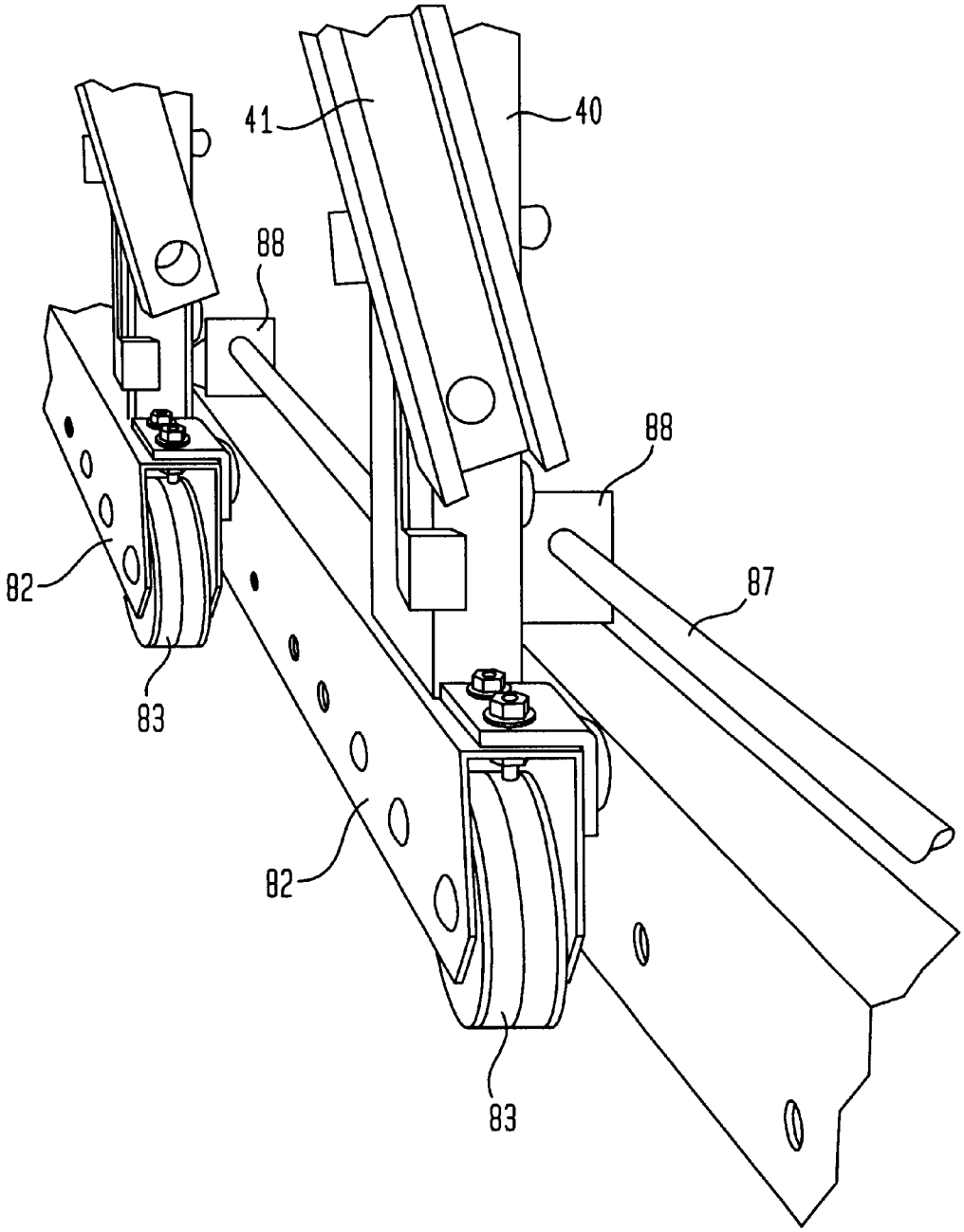
FIG. 20 is a perspective representation of a further plurality of sequentially nested wheeled frame arrangements on the side from that shown in FIG. 19.

FIG. 20 is a perspective representation of the mirror image of the wheeled frame elements and roller based portions shown in FIG. 19. The corresponding elements of structure in FIG. 20 are similarly designated, since it is a feature of the present invention that the same mechanical components can be used on either side of the deployable seating arrangement, thereby obviating the need for manufacturing, stocking, or assembling different mirror image parts. Some elements of structure, however, such as a guide way 88 and gravity latch 90, are not mirror image elements.

FIG. 20 additionally shows a guide arrangement that insures that the respective wheel base portions 82 remain in sequential nesting relation to one another. This is achieved by employing a guide bar 87 arranged parallel with each wheel base portion 82 of the wheeled frame elements. The guide bar is accommodated within guide way 88 of an adjacent roller based portion. Thus, as the roller based portions travel during deployment and undeployment of the deployable seating arrangement, they are constrained to remain in parallel relation to one another by operation of the engagement between the guide bar and the guideway. In the present invention, guide bars having a diameter of ½" are used, as compared to convention guide bars having a diameter of ⅜".

Figure 21:
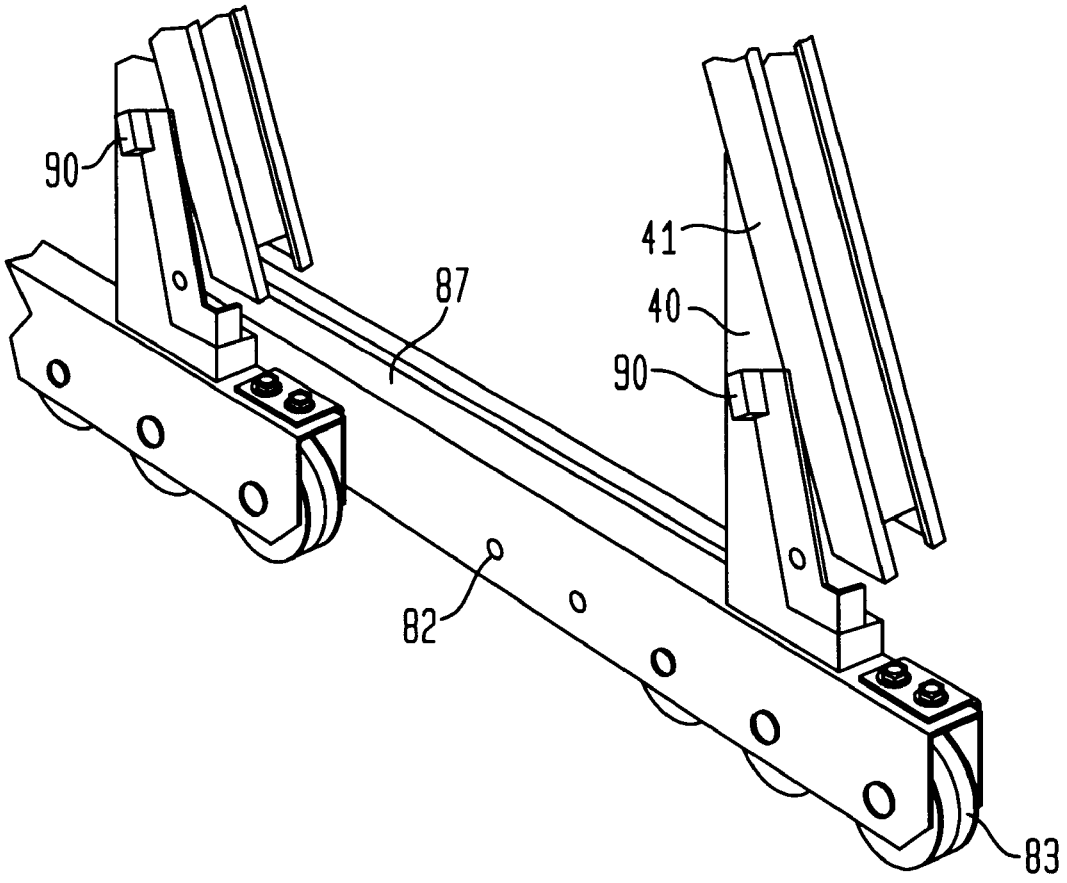
FIG. 21 is an isomeric representation showing a detail of the base portion of a wheeled frame arrangement showing a guide arrangement and a latching system.

FIG. 21 is a perspective representation of wheel base portion 82 showing a gravity latch 90 that serves to latch adjacent ones of the roller based portion in fixed axial relation to one another. The gravity latch can be seen in greater detail in FIG. 22.

Figure 22:
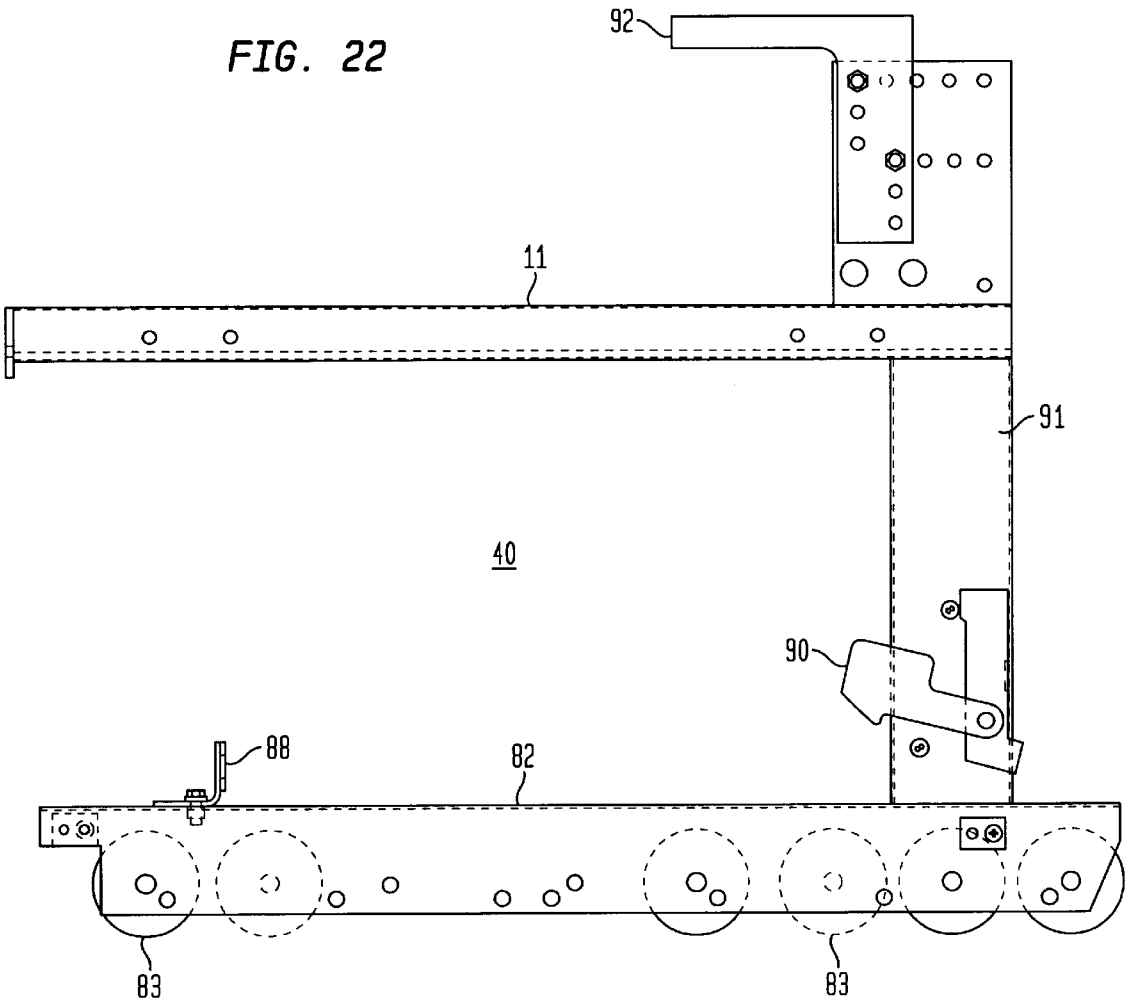
FIG. 22 is simplified schematic representation of a wheeled frame arrangement coupled to an associated seating level.

FIG. 22 is a simplified schematic representation of a wheeled frame element 40 having a vertically extending portion 91 that is coupled to wheel base portion 82. As previously noted, wheel base portion 82 has associated therewith a plurality of wheels 83. In this specific embodiment, wheels 83 are replaceable with wheels of different sizes (not shown), such differently sized wheels being axially installable on the wheel base portion in selectable ones of axle mounting holes A–O. In this figure, gravity latch 90*a* is a more modern form of row lock than gravity latch 90 shown in FIG. 21.

Figure 23:
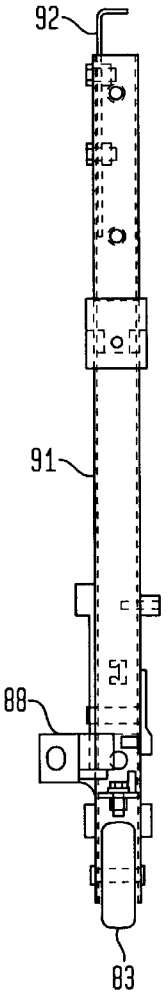
FIG. 23 is a simplified schematic end representation of the embodiment of FIG. 22.

FIG. 23 is a simplified schematic representation of the embodiment of FIG. 22. Referring to both FIGS. 22 and 23, in addition to gravity latch 90, there is provided a laterally extending catch 93. As the roller bases of the plurality of wheeled frame elements are displaced during deployment, latch 90 of an inward rotor based portion will communicate with guide way 88 of the immediately outer roller base portion, whereupon the adjacent roller base portions are latched in a deployed condition.

Figure 24:
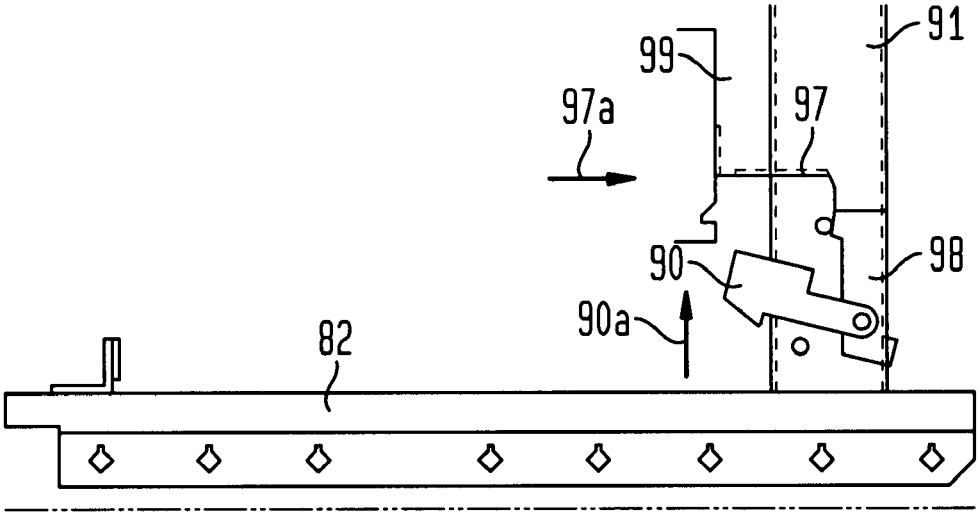
FIG. 24 is simplified schematic representation of a wheeled frame arrangement showing actuation to effect delatching during undeployment.

FIG. 24 is simplified schematic representation of a portion of wheel base portion 82 showing actuation of latch 90 to effect delatching during undeployment. In this embodiment of the invention, a first row lock trip 97 of a stacking angle 99 is urged against delatching arm 98, in the direction of arrow 97*a*, whereupon latch 90 is correspondingly urged upward in the direction of arrow 90*a*.

Figure 25:
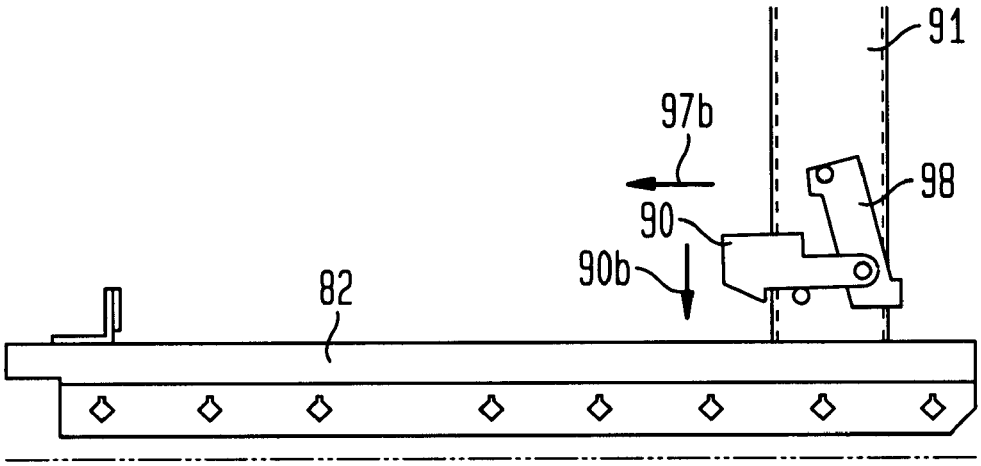
FIG. 25 is simplified schematic representation of the wheeled frame arrangement of FIG. 24 showing the latching arrangement in a latching position.

FIG. 25 is simplified schematic representation of the wheeled frame arrangement of FIG. 24 showing latch 90 in a latched position. Upon disengagement (in the direction of arrow 97*b*) of first row lock trip 97 from delatching arm 98, latch 90 is correspondingly urged downward in the direction of arrow 90*b*. In this embodiment, the downward travel of latch 90 is responsive to gravity. In other embodiments, however, a resilient biasing element (not shown), such as a spring, may be employed in the practice of the invention to urge latch 90 downward.

Figure 26:
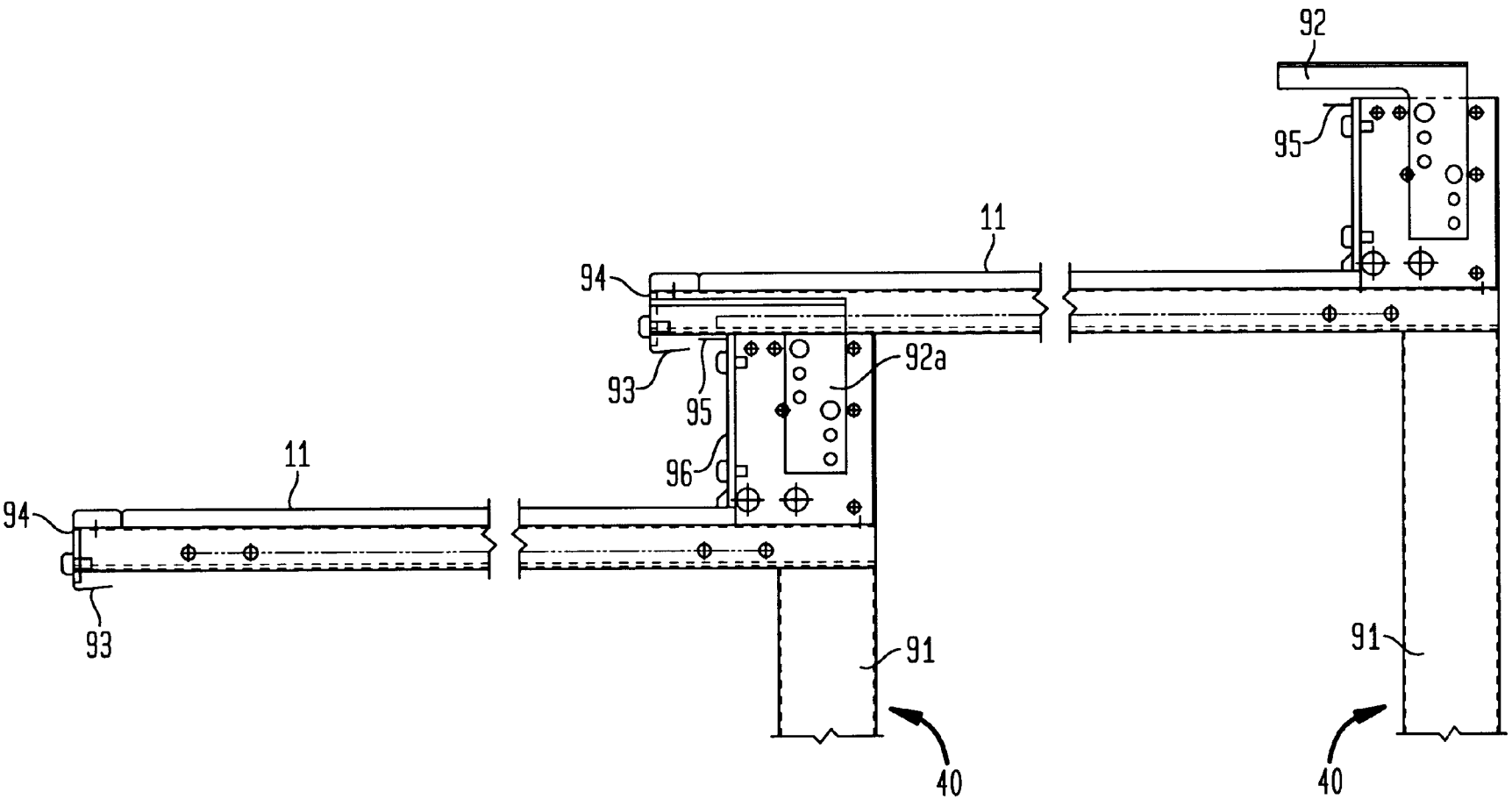
FIG. 26 is a simplified schematic side representation of a plurality of seating levels showing inter-level coupling.

FIG. 26 is simplified schematic representation of two seating level members 11, showing the manner in which a nose beam rearward extending portion 93 of a nose beam 94 is disposed with respect to a riser forward extending portion 95 of a riser 96. A stop bracket 92 attached to vertically extending portion 91 communicates with nose beam 94. The nose beam and the riser beam, however, do not touch. As described herein, the stop brackets are adjustable for rise and span. This figure shows a stop bracket 92*a* that during the course of deployment is urged forward (in the direction of deployment) until the forwardmost end of the stop bracket communicates with the inside of nose beam 94. The riser itself, therefore, does not communicate with the nose beam.

Figure 27:
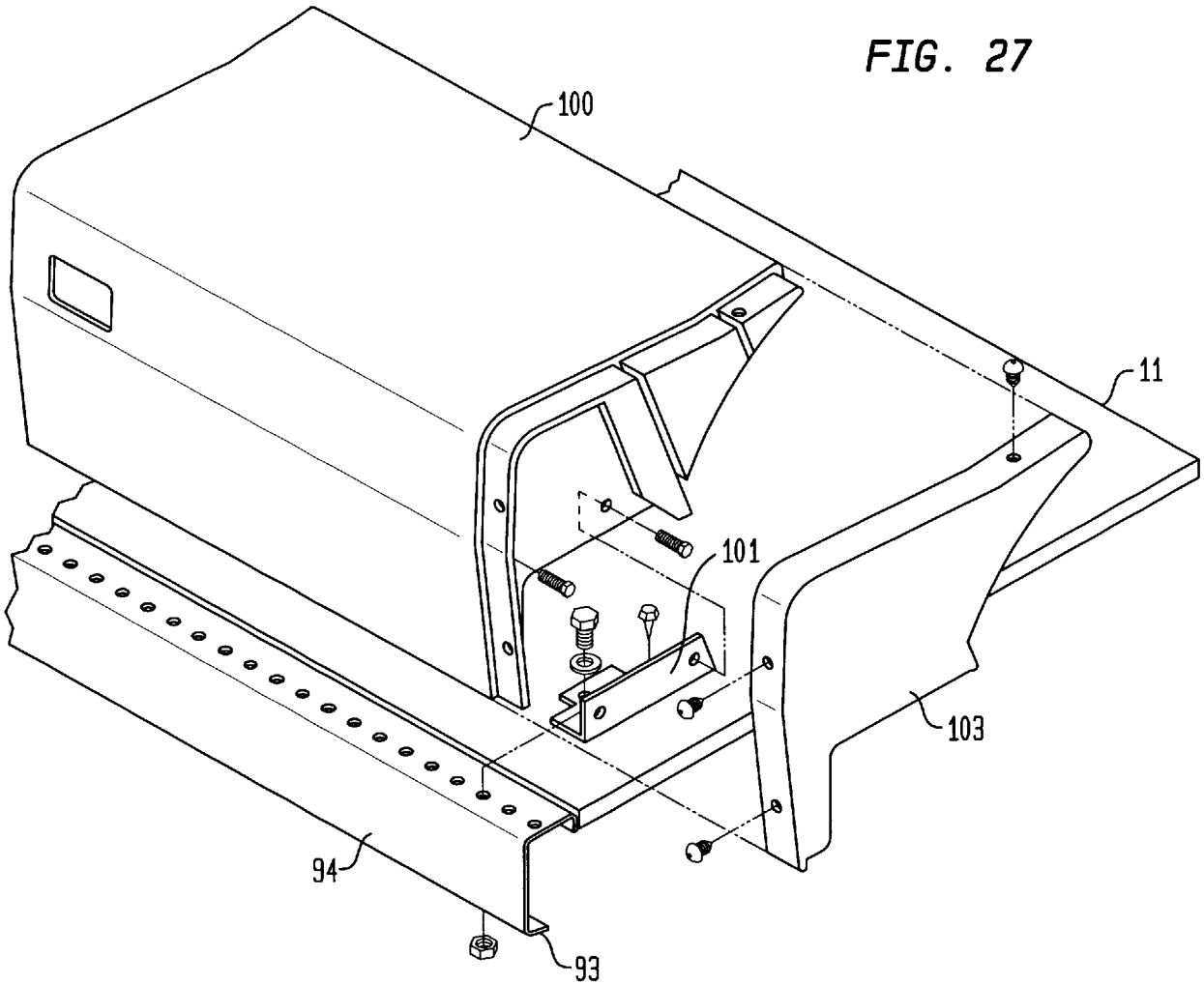
FIG. 27 is an isometric representation of a seating unit and an associated end cap for installation on a seating level.

FIG. 27 is simplified schematic isometric representation of a seat level member 11 having a seat unit 100 to be installed thereon. The seat unit is coupled to the seating level member by operation of a mounting bracket 101 which employs a plurality of fasteners. Once the seat unit is installed on the seating level member, a first end cap 103 is installed with fasteners.

Figure 28:
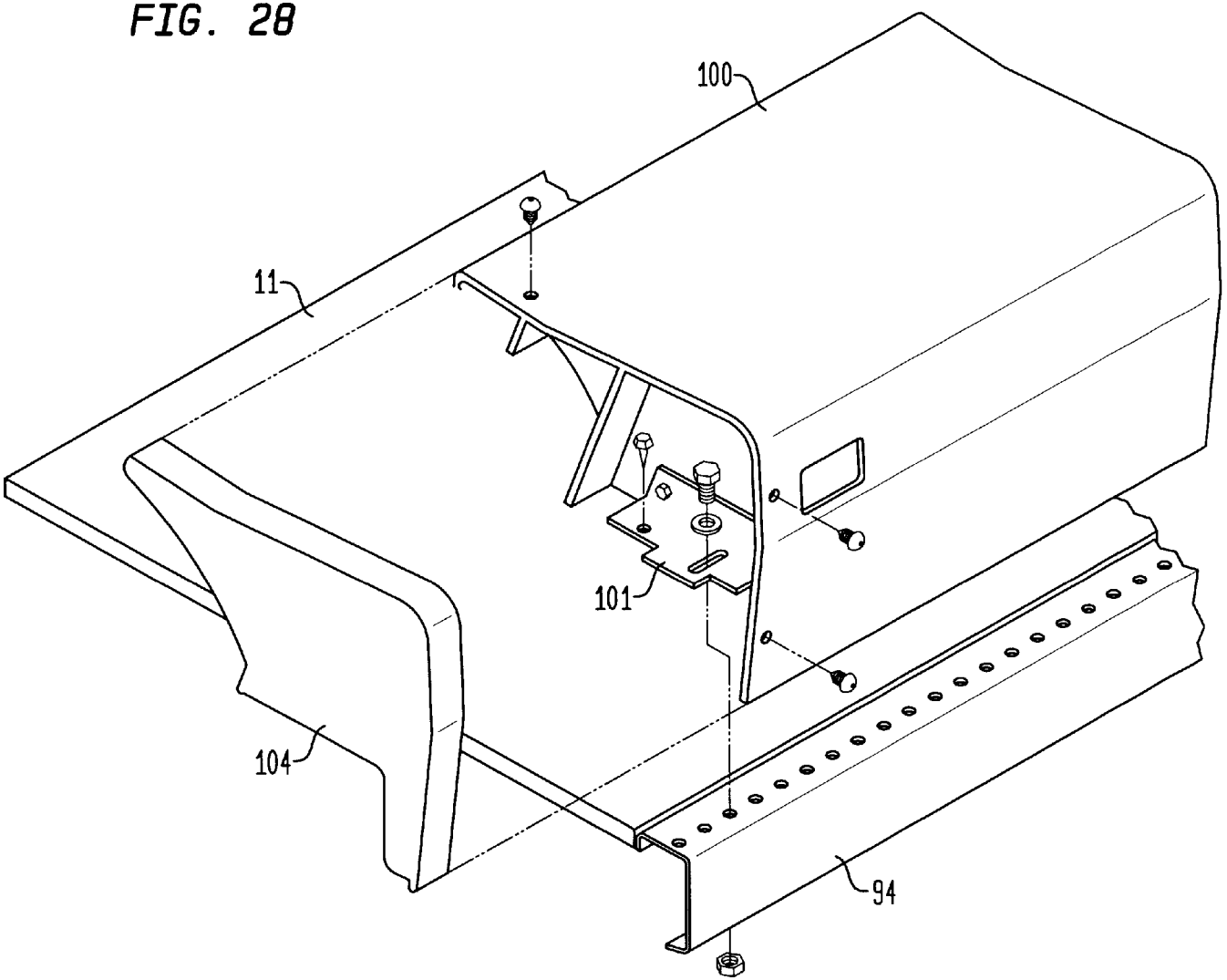
FIG. 28 is an isometric representation of the seating unit of FIG. 27 shown from a distal end, along with an end cap therefore.

FIG. 28 is a simplified schematic isometric representation of the other end of seat unit 100, the ends of which may be configured as male/female engaging ends. Once this end is installed using a bracket 101, a second end cap 104 is installed thereon using fasteners.

Figure 29:
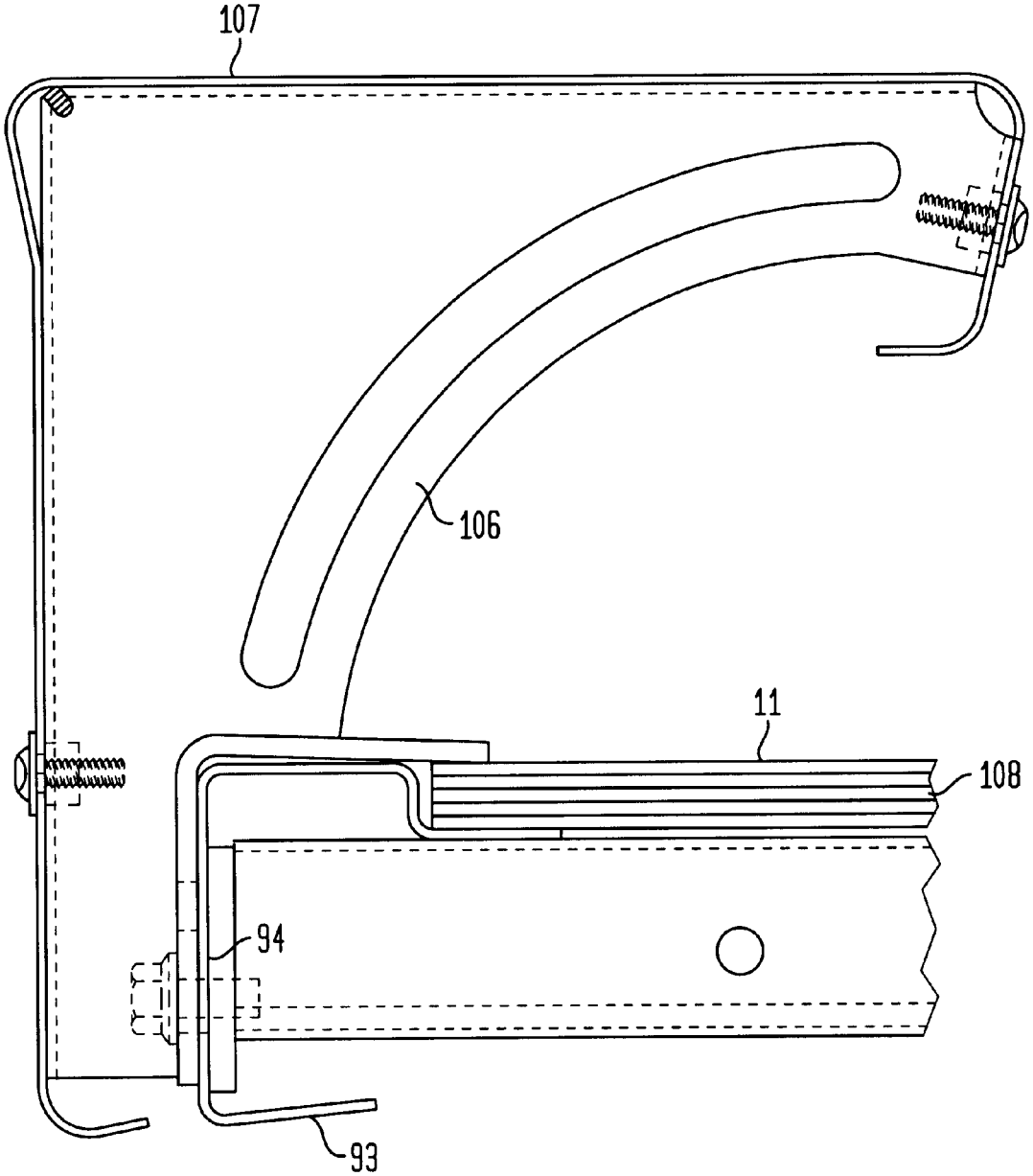
FIG. 29 is a simplified schematic plan representation of a seat bracket having a sheet material as a cover.

FIG. 29 is s simplified schematic plan representation of a seat bracket that is useful to form a seating unit for a seating level member 11. In this embodiment, seat bracket 106 is coupled with a sheet material 107, which may be a plastic or metallic material. In this embodiment, the upper surface of seating level member 11 is covered with plywood 108.

Figure 30:
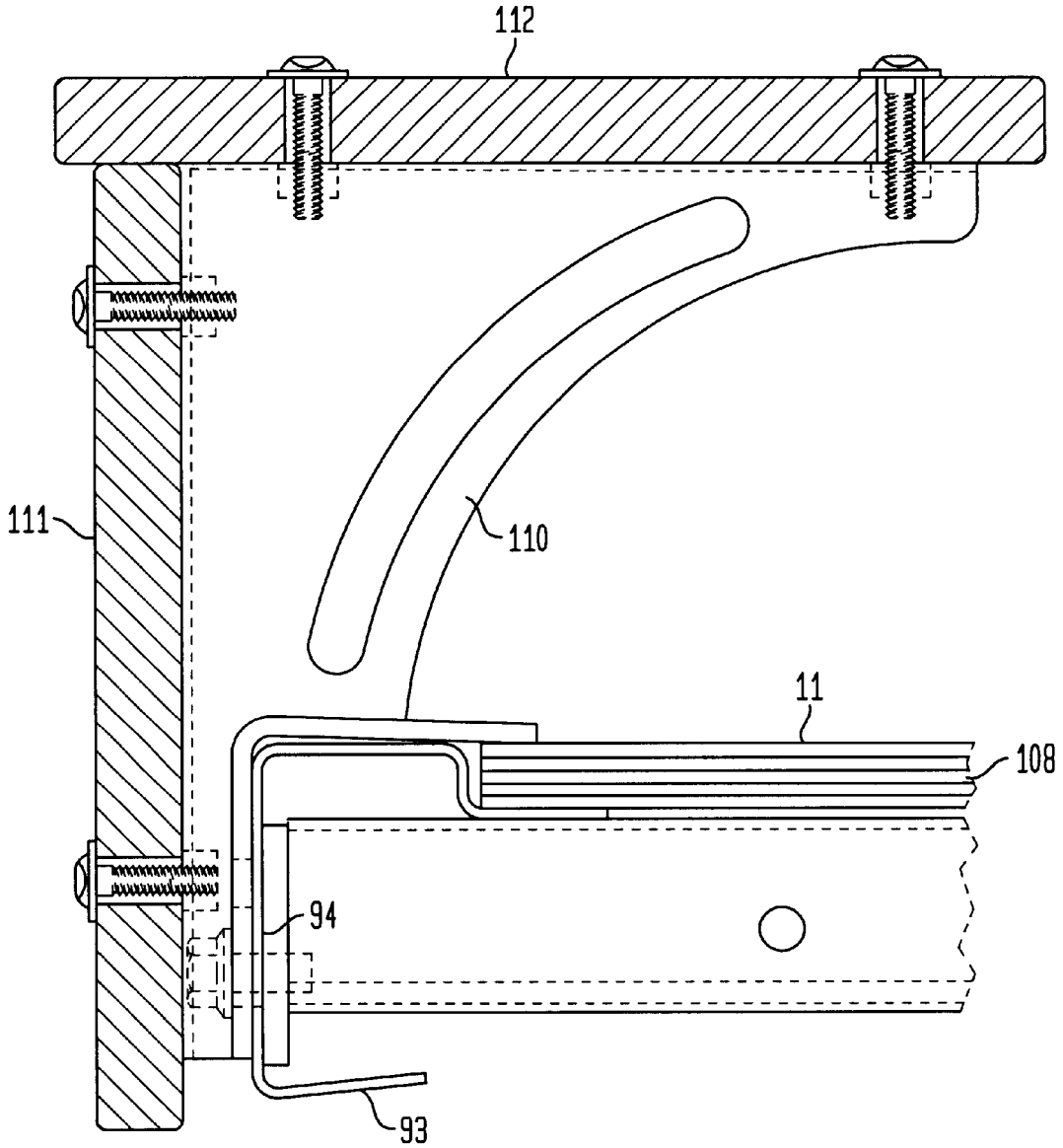
FIG. 30 is a simplified schematic plan representation of a seat bracket having a wooden cover.

FIG. 30 is a simplified schematic plan representation of a further seat bracket 110 that employs plywood sections 111 and 112 to form the seating surfaces. Additional fasteners are used to secure the plywood to the further seat bracket.

Figure 31:
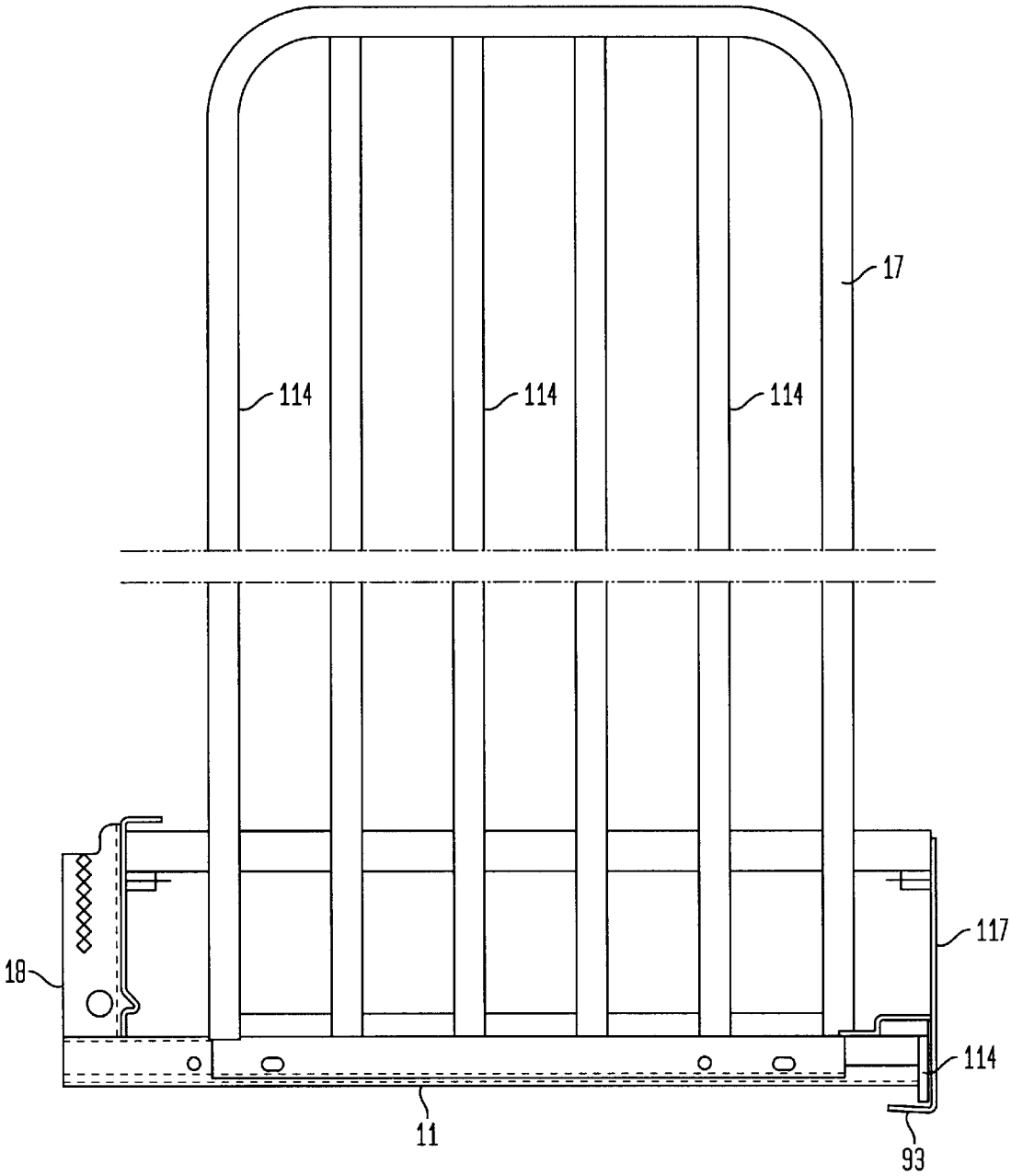
FIG. 31 is plan representation of a nestable guardrail support.

FIG. 31 is a simplified plan representation of a nesting guardrail 17, as previously discussed herein above with respect to FIG. 2. In this embodiment, nesting guardrail 17 is arranged on a seating level member 11 and is formed of a plurality of vertical sections 114. The nesting guardrail is coupled to seating level member 11 by a front bracket 117 and a rear bracket 118.

Figure 32:
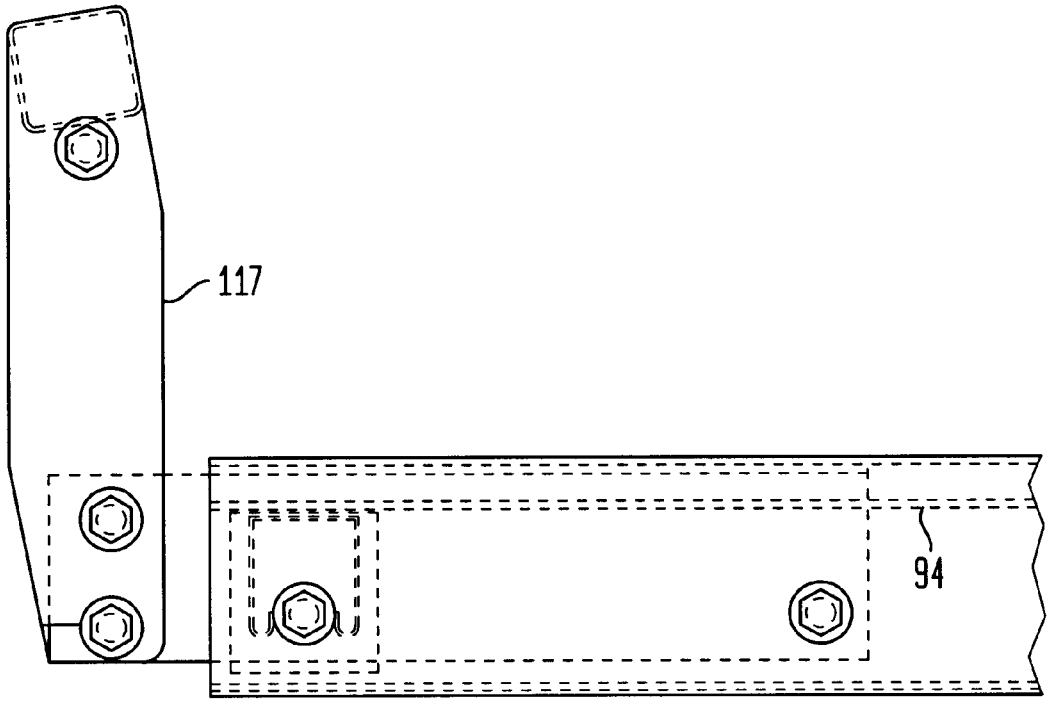
FIG. 32 is a simplified schematic plan representation of a front bracket for connecting the nestable guardrail of FIG. 31 to a seating level.

FIG. 32 is a simplified schematic representation of front bracket 117 which is coupled to nose beam 94.

Figure 33:
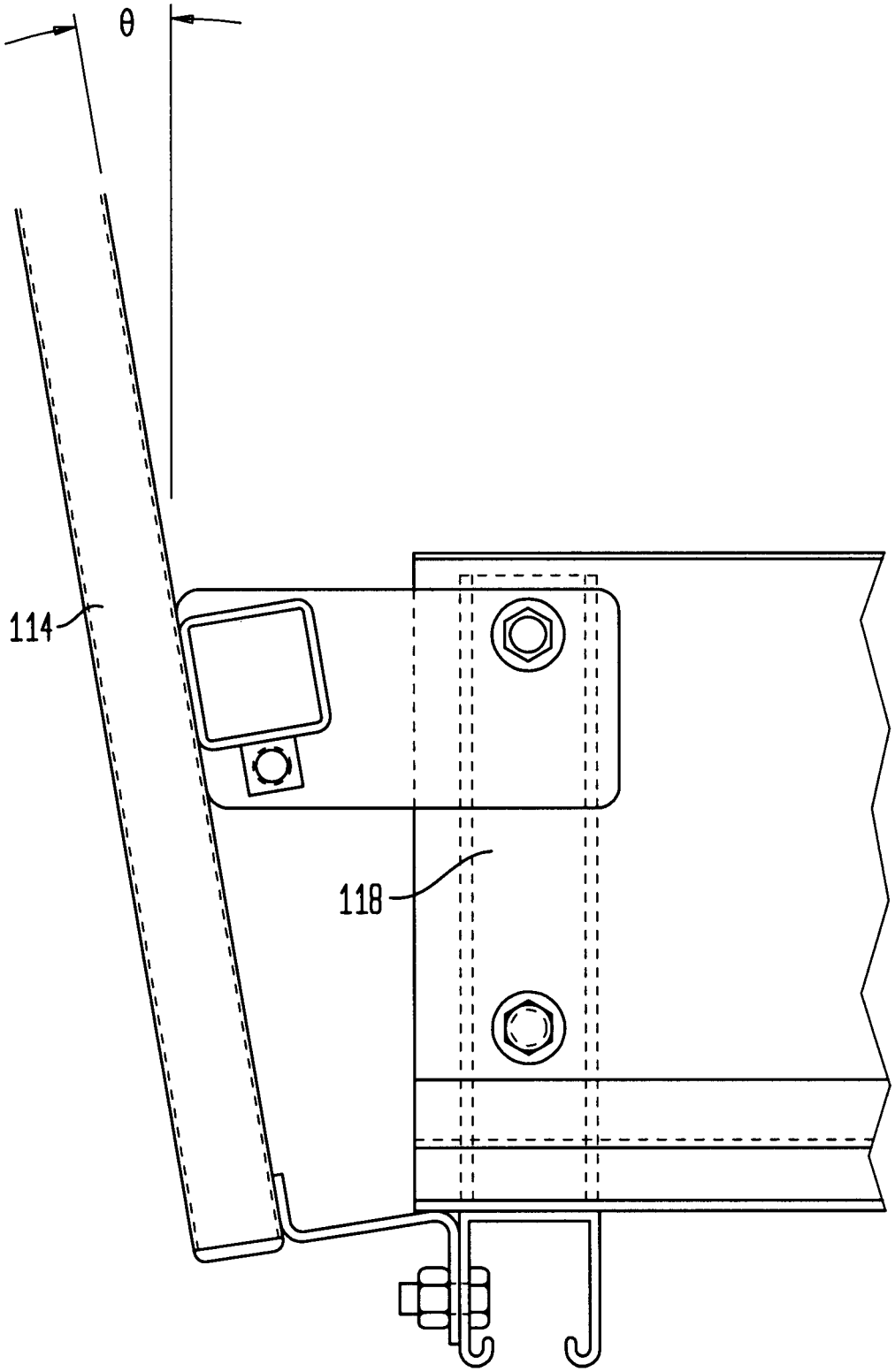
FIG. 33 is a simplified schematic representation of a rear bracket for connecting the nestable guardrail of FIG. 31 to a seating level.

FIG. 33 is a simplified schematic representation of rear bracket 118 which is shown to support nesting guardrail 17 at a predetermined angle θ with respect to the vertical. In this specific illustrative embodiment of the invention, the angle θ is 9°.

Figure 34:
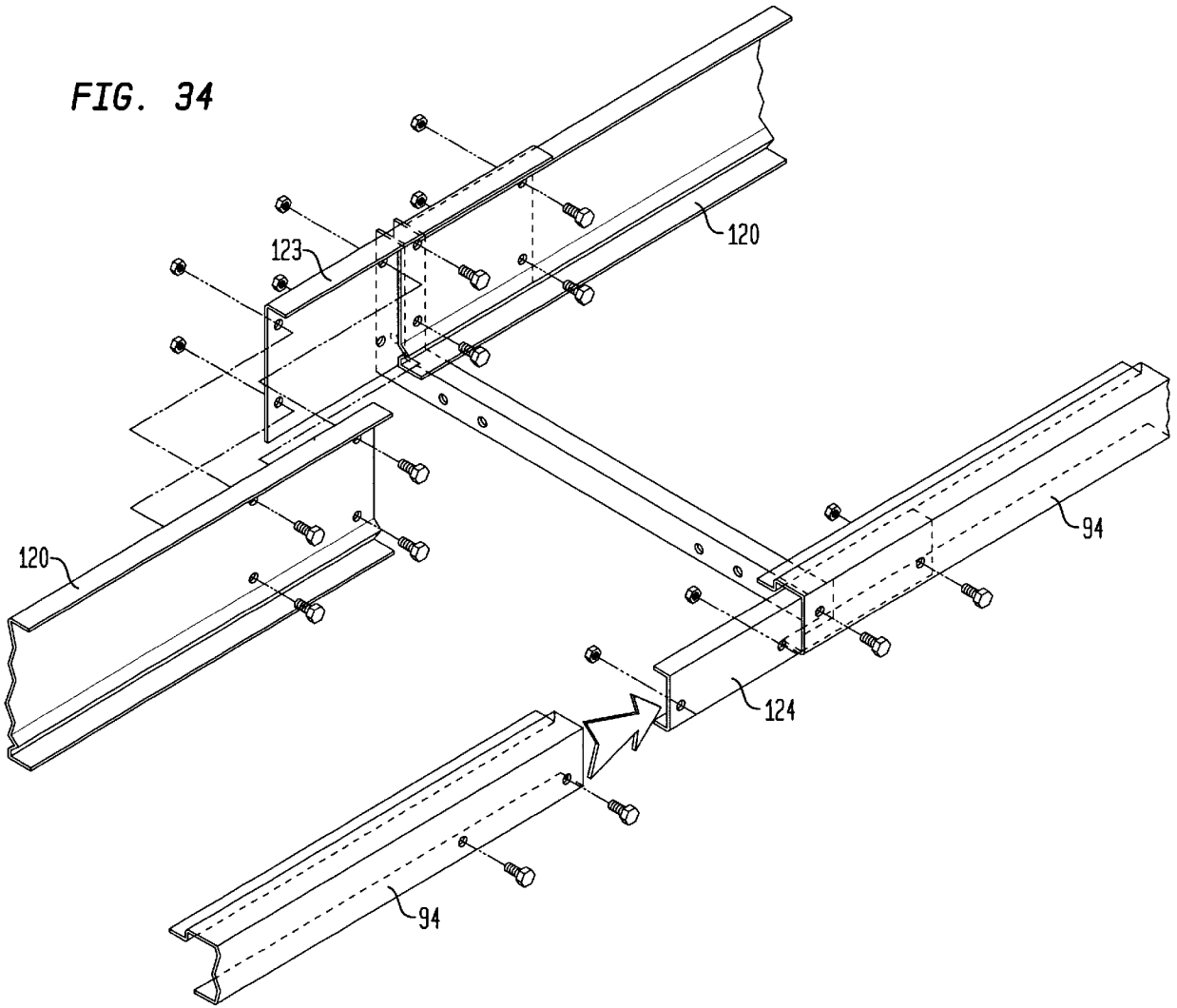
FIG. 34 is an isometric representation of a splicing arrangement for the nose beam and riser portions of a seating level.

FIG. 34 is a simplified schematic isometric representation showing the manner in which riser and nose beam splices are achieved. As shown, a riser portion 120 and a riser portion 121 are coupled to each other by operation of a riser splice member 123 using a plurality of fasteners. Similarly, nose beam portions 94 are coupled to one another using a nose beam splice member 124 and a further plurality of fasteners. This splicing arrangement obviates the need for producing unduly elongated riser and nose beam sections. Riser splice member 123 and nose beam splice member 124 serve to minimize deflections of the decks in all directions. Most importantly, however, the risers are firmly fixed to one another, as are nose beams, thereby maintaining the seating levels axially straight during deployment.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A deployable seating arrangement having deployed and undeployed states comprising:

a plurality of seating level members each having first and second ends and arranged in sequentially elevated relation wherein each of said plurality of seating level members is disposed substantially directly beneath an immediately superior one of said plurality of seating level members in substantially stacked relation when the deployable seating arrangement is in the undeployed state, and wherein each of said plurality of seating level members is disposed beneath and forward of an immediately superior one of said plurality of seating level members in stepped relation when the deployable seating arrangement is in the deployed state;

a plurality of first L-shaped frame elements each formed of vertical and horizontal portions coupled at their ends to each other in an L-shape, each of said first L-shaped frame elements being coupled to one of said plurality of seating level members at one of the first or second ends, whereby when the deployable seating arrangement is in the undeployed state, said first L-shaped frame elements are arranged vertically;

a plurality of rollers each coupled rotatively to a vertical portion of one of said plurality of first L-shaped frame elements, each roller being arranged to communicate with a horizontal portion of an L-shaped frame element of a superior seating level member;

a plurality of second L-shaped frame elements each formed of vertical and horizontal portions coupled at their ends to each other in an L-shape, each of said second L-shaped frame elements being coupled to one of said plurality of seating level members intermediate of its first and second ends, whereby when the deployable seating arrangement is in the undeployed state, said second L-shaped frame elements are arranged vertically;

a triangulation frame for each of said plurality of seating level members for reducing sway of the deployable seating arrangement, said triangulation frame being coupled to the second L-shaped frame element of the seating level member of the triangulation frame; and a plurality of wheeled frame arrangements each coupled to one of said plurality of seating level members and disposed laterally outward of said plurality of seating level members where the first L-shaped frame elements are coupled, each wheeled frame arrangement being situated at a distance from a wheeled frame arrangement of said plurality of seating level members.

2. The deployable seating arrangement of claim 1, wherein each wheeled frame arrangement is arranged laterally inward of a wheeled frame arrangement of an immediately superior seating level member.

3. The deployable seating arrangement of claim 1, wherein each of said rollers is engageable with the underside of the horizontal portion of the L-shaped frame element of a superior seating level member.

4. The deployable seating arrangement of claim 3, wherein each of said rollers is provided with a radially extended central portion for engaging with a depression in the underside of the horizontal portion of the L-shaped frame element of a superior seating level member, whereby the horizontal portion of the L-shaped frame element of a superior seating level member is retained in engagement with each of said rollers.

5. The deployable seating arrangement of claim 3, wherein each of said rollers is provided with a radially extended lateral portion for defining a radially depressed central region of each of said rollers for accommodating therewithin the underside of the horizontal portion of the L-shaped frame element of a superior seating level member, whereby the horizontal portion of the L-shaped frame element of a superior seating level member is retained in engagement with each of said rollers.

6. The deployable seating arrangement of claim 1, wherein there is further provided a drive arrangement coupled to one of said seating level members for urging the one of said seating level members between the deployed and undeployed states, and said drive arrangement comprises a source of rotatory energy.

7. The deployable seating arrangement of claim 6, wherein said source of rotatory energy is a motor, and there is further provided a traction element coupled to said motor for applying a traction force to a surface on which the deployable seating arrangement is disposed.

8. The deployable seating arrangement of claim 7, wherein said traction element comprises first and second traction wheels arranged on sides of the deployable seating arrangement, on either side of said motor, for preventing skewing of the various seating level members during deployment and undeployment of the deployable seating arrangement.

9. The deployable seating arrangement of claim 1, wherein there is further provided a backstop for each of said plurality of seating level members, said backstops extending vertically upward therefrom.

10. The deployable seating arrangement of claim 9, wherein each of said plurality of backstops is coupled to the vertical portion of those of said first L-shaped frame elements of said plurality of seating level members.

11. The deployable seating arrangement of claim 1, wherein there is further provided latch means for latching a selected seating level member in the undeployed state to a first adjacent seating level member.

12. The deployable seating arrangement of claim 11, wherein there is further provided sequential delatching means for delatching each seating level member sequentially in response to undeployment of a second adjacent seating level member.

13. The deployable seating arrangement of claim 12, wherein said latching means comprises a gravity-actuated latching element installed on the selected seating level member, said gravity-actuated latching element being urged into a delatched position in response to undeployment of the second adjacent seating level member.

14. The deployable seating arrangement of claim 13, wherein there is further provided a delatching protuberance on said second adjacent seating level member for communicating with said gravity-actuated latching element installed on the selected seating level member.

15. A deployable seating arrangement having deployed and undeployed states comprising:

a plurality of seating level members each having first and second ends and arranged in sequentially elevated relation to each other, wherein each seating level member is disposed substantially directly beneath an immediately superior seating level member in substantially stacked relation when the deployable seating arrangement is in the undeployed state, and wherein each seating level member is disposed beneath and forward of an immediately superior seating level member in stepped relation when the deployable seating arrangement is in the deployed state, each seating level member having:

a frame element for supporting the seating level member, said frame elements being arranged directly vertically in communication with each other to be translatable with respect to each other during deployment and undeployment;

a wheeled frame arrangement coupled thereto and disposed laterally outward of the frame element, the wheeled frame arrangement being arranged laterally inward of a wheeled frame arrangement of an immediately superior seating level member; and a triangulation frame member for reducing sway of the deployable seating arrangement; and a drive arrangement coupled to one of said seating level members for urging the one of said seating level members between the deployed and undeployed states.

16. The deployable seating arrangement of claim 15, wherein said frame element comprises:

vertical and horizontal portions coupled at their ends to each other in an L-shape, the frame elements of the seating level members being arranged directly vertically in relation to each other; and a roller coupled rotatively to the vertical portion, each roller being arranged to communicate with a horizontal portion of an L-shaped frame element of a superior seating level member.

17. The deployable seating arrangement of claim 15, wherein there is further provided a latching arrangement for latching a seating level member in the undeployed state.

18. The deployable seating arrangement of claim 15, wherein said drive arrangement comprises a source of rotatory energy coupled to a lowermost one of said plurality of seating level members.

19. The deployable seating arrangement of claim 18, wherein said source of rotatory energy is a motor, and there is further provided a traction element coupled to said motor for applying a traction force to a surface on which the deployable seating arrangement is disposed.

20. The deployable seating arrangement of claim 19, wherein said traction element comprises first and second traction wheels arranged on the sides of the deployable seating arrangement, on either side of said motor, for preventing skewing of the various seating level members during deployment and undeployment of the deployable seating arrangement.

21. A deployable seating arrangement having deployed and undeployed states comprising:

a plurality of seating level members each having first and second ends and arranged in sequentially elevated relation to each other, wherein each seating level member is disposed substantially directly beneath an immediately superior seating level member in substantially stacked relation when the deployable seating arrangement is in the undeployed state, and wherein each seating level member is disposed beneath and forward of an immediately superior seating level member in stepped relation when the deployable seating arrangement is in the deployed state;

a plurality of first frame elements for supporting ones of said plurality of seating level members at one of the first or second ends and arranged directly vertically in communication with each other to be translatable with respect to each other during deployment and undeployment;

a plurality of second frame elements for supporting ones of said plurality of seating level members intermediate of the first or second ends and arranged directly vertically in communication with each other to be translatable with respect to each other during deployment and undeployment;

a triangulation frame for each of said plurality of seating level members for reducing sway of the deployable seating arrangement, said triangulation frame being coupled to the second frame element of the seating level member of the triangulation frame; and a plurality of wheeled frame arrangements each coupled to one of said plurality of seating level members and disposed laterally outward of said plurality of seating level members where the frame elements are coupled, each wheeled frame arrangement being situated at a distance from a wheeled frame arrangement of said plurality of seating level members.

22. The deployable seating arrangement of claim 21, wherein said frame elements each are comprised of vertical and horizontal portions coupled at their ends to each other in an L-shape.

23. The deployable seating arrangement of claim 21, wherein there is further provided a drive arrangement coupled to a lowermost one of said seating level members for urging the lowermost one of said seating level members between the deployed and undeployed states, and said drive arrangement comprises a wide track drive arrangement.

24. The deployable seating arrangement of claim 23, wherein said drive arrangement comprises a chain-type drive power delivery system.

25. The deployable seating arrangement of claim 21, wherein there is further provided an electrical guideway extending along at least one of said plurality of seating level members.

26. The deployable seating arrangement of claim 18, wherein said plurality of seating level members, said plurality of frame elements and said plurality of wheeled frame arrangements have a forward portion of the deployable seating arrangement; and there is further provided a rear portion of the deployable seating arrangement, the rear portion of the deployable seating arrangement comprising:

a plurality of rear seating level members each having first and second ends and arranged in sequentially elevated relation to each other, wherein each rear seating level member is disposed substantially directly beneath an immediately superior rear seating level member in substantially stacked relation when the deployable seating arrangement is in the undeployed state, and wherein each rear seating level member is disposed beneath and forward of an immediately superior rear seating level member in stepped relation when the deployable seating arrangement is in the deployed state;

a plurality of rear frame elements for supporting ones of said plurality of rear seating level members and arranged directly vertically in communication with each other to be translatable with respect to each other during deployment and undeployment;

a drive arrangement coupled to a lowermost one of said rear seating level members for urging the lowermost one of said rear seating level members between the deployed and undeployed states; and a plurality of rear wheeled frame arrangements each coupled to a one of said plurality of rear seating level members and disposed laterally outward of said plurality of rear seating level members where the frame elements are coupled, each rear wheeled frame arrangement being arranged laterally inward of a rear wheeled frame arrangement of an immediately superior rear seating level member.

27. The deployable seating arrangement of claim 26, said rear drive arrangement comprises wide track drive arrangement.

28. The deployable seating arrangement of claim 27, wherein said rear drive arrangement comprises a chain-type drive power delivery system.

29. The deployable seating arrangement of claim 26, wherein there is further provided a first rear triangulation frame member for each of said plurality of rear seating level members for reducing sway of the deployable seating arrangement.

30. The deployable seating arrangement of claim 29, wherein there is further provided a second rear triangulation frame member for each of said plurality of rear seating level members for reducing sway of the deployable seating arrangement.

31. The deployable seating arrangement of claim 26, wherein there is provided a plurality of further rollers each coupled rotatively to a one of said plurality of rear frame elements, each further roller being arranged to communicate with a rear frame element of a superior rear seating level member.

32. The deployable seating arrangement of claim 26, wherein there is further provided coupling means for coupling the lowermost one of said plurality of rear seating level members to an uppermost one of said plurality of seating level members, whereby when the deployable seating arrangement is in the undeployed state, each rear seating level member is disposed substantially directly beneath an immediately superior rear seating level member in substantially stacked relation to form a stack of rear seating level members, and each seating level member is disposed substantially directly beneath an immediately superior seating level member to form a stack of seating level members, said stack of seating level members being disposed forward of said stack of rear seating level members.

33. The deployable seating arrangement of claim 32, wherein during deployment of the deployable seating arrangement, said stack of seating level members is arranged to deploy prior to deployment of said stack of rear seating level members.

34. The deployable seating arrangement of claim 21, wherein each of said wheeled frame arrangement is arranged laterally inward of a wheeled frame arrangement of an immediately superior seating level member.

35. The deployable seating arrangement of claim 21, wherein there is further provided a plurality of rollers each coupled rotatively to a one of said plurality of frame elements, each roller being arranged to communicate with a frame element of a superior seating level member.

36. A deployable seating arrangement having deployed and undeployed states comprising:

a plurality of seating level members each having first and second ends and arranged in sequentially elevated relation to each other, wherein each seating level member is disposed substantially directly beneath an immediately superior seating level member in substantially stacked relation when the deployable seating arrangement is in the undeployed state, and wherein each seating level member is disposed beneath and forward of an immediately superior seating level member in stepped relation when the deployable seating arrangement is in the deployed state, each seating level member having first and second seating level portions disposed axially with respect to each other, and being further provided with;

first and second nose beam portions;

a nose beam splice coupler for coupling said first and second nose beam portions to each other;

first and second riser beam portions;

a riser beam splice coupler for coupling said first and riser beam portions to each other; and a frame element for supporting the seating level member, said frame element being coupled to said nose beam splice coupler and to said riser beam splice coupler.

37. The deployable seating arrangement of claim 36, wherein each seating level member is further provided with;

a wheeled frame arrangement coupled thereto and disposed laterally outward of the frame element, the wheeled frame arrangement being arranged laterally inward of a wheeled frame arrangement of an immediately superior seating level member; and a triangulation frame member for reducing sway of the deployable seating arrangement.

38. The deployable seating arrangement of claim 37, wherein each seating level member is further provided with a further triangulation frame member for reducing sway of the deployable seating arrangement.

39. The deployable seating arrangement of claim 37, wherein there is further provided a guide arrangement on said wheeled frame arrangement for maintaining a distance between adjacent wheeled frame arrangements during deployment and undeployment.

40. The deployable seating arrangement of claim 39, wherein said guide arrangement comprises a longitudinal guide element and an engagement element for engaging with the longitudinal guide element of an adjacent wheeled frame arrangement.

41. The deployable seating arrangement of claim 37, wherein there are further provided:

a plurality of L-shaped frame elements each formed of vertical and horizontal portions coupled at their ends to each other in an L-shape, each of said L-shaped frame elements being coupled to one of said plurality of seating level members, whereby when the deployable seating arrangement is in the undeployed state, said L-shaped frame elements are arranged directly vertically in relation to each other; and a plurality of rollers each coupled rotatively to a vertical portion of one of said plurality of L-shaped frame elements, each roller being arranged to communicate with a horizontal portion of an L-shaped frame element of a superior seating level member.

42. The deployable seating arrangement of claim 36, wherein there is further provided first and second drive arrangements coupled to a lowermost one of said seating level members for urging the lowermost one of said seating level members between the deployed and undeployed states, said first and second drive arrangements being disposed axially with respect to each other.

43. The deployable seating arrangement of claim 42, wherein said first and second drive arrangements are first and second wide track power systems.

44. The deployable seating arrangement of claim 43, wherein said first and second wide track powers systems are chain drive systems.

45. The deployable seating arrangement of claim 36, wherein there is further provided first and second electrical conduit means for guiding electrical wiring on a back side of said first and second riser beam portions, respectively, said first and second electrical conduit means being substantially in axial registration with each other.

* * * * *